US008610013B2

(12) United States Patent
Schmidt et al.

(10) Patent No.: US 8,610,013 B2
(45) Date of Patent: Dec. 17, 2013

(54) ROTARY CONTROL WITH HAPTIC EFFECTS AND METHOD OF MANUFACTURING THEREOF

(75) Inventors: Robert Schmidt, Livonia, MI (US); Charles B. Banter, Northville, MI (US)

(73) Assignee: Methode Electronics, Inc., Carthage, IL (US)

( * ) Notice: Subject to any disclaimer, the term of this patent is extended or adjusted under 35 U.S.C. 154(b) by 120 days.

(21) Appl. No.: 13/074,691

(22) Filed: Mar. 29, 2011

(65) Prior Publication Data

US 2012/0247934 A1 Oct. 4, 2012

(51) Int. Cl.

| | |
|---|---|
| ***H01H 3/08*** | (2006.01) |
| ***H01H 19/00*** | (2006.01) |
| ***H01H 19/14*** | (2006.01) |
| ***H01H 21/00*** | (2006.01) |

(52) U.S. Cl.
USPC ..... 200/336

(58) Field of Classification Search
USPC ..... 200/336, 329, 337, 338, 341, 17 R, 200/19.07, 19.18–19.19, 520, 564–566, 200/11 TW, 11 R, 260–262, 265, 266, 270, 200/276, 276.1, 277.1, 316
See application file for complete search history.

(56) References Cited

U.S. PATENT DOCUMENTS

| | | | | |
|---|---|---|---|---|
| 7,733,659 | B2 * | 6/2010 | Snider et al. | 361/752 |
| 2011/0011712 | A1 * | 1/2011 | Klinghult | 200/341 |

FOREIGN PATENT DOCUMENTS

JP 2000207988 A * 7/2000

* cited by examiner

*Primary Examiner* — Edwin A. Leon
*Assistant Examiner* — Anthony R. Jimenez
(74) *Attorney, Agent, or Firm* — Blank Rome LLP

(57) ABSTRACT

A rotary switch assembly includes a knob, a wheel joined to the knob, a first frame that moves toward the wheel, a second frame joined to the first frame, and a shape memory alloy member made from a shape memory alloy and joined to the second frame. The shape memory alloy member changes shape, and the second frame transforms the changing shape of the shape memory alloy member into movement of the first frame.

14 Claims, 25 Drawing Sheets

| Deflection Force (F) for given Strain (δ) and Wire Size (Cross Sectional Area) | | | | | | | | | | |
|---|---|---|---|---|---|---|---|---|---|---|
| δ mm | 0.44 | | E (martinsite phase) | | 28 | GPa | E (austinite phase) | | 75 | GPa |
| | | | | | 28000000000 | Pa | | | 75000000000 | Pa |
| | | | | | | | | | | |
| ε % | 2 | 0.02 | | L (mm) | 50 | | | | | |
| | σ (MPa) | 560 | | | | | | | | |
| Φ (μm) | Φ (mm) | Φ (m) | A (m²) | F (N) | F (g) | σ (Pa) | σ (MPa) | | | |
| 236 | 0.236 | 0.000236 | 4.37435E-08 | 24.49638 | 2497.935085 | 560000000 | 560 | | | |
| 314 | 0.314 | 0.000314 | 7.74371E-08 | 43.364786 | 4421.976561 | 560000000 | 560 | | | |
| 394 | 0.394 | 0.000394 | 1.21922E-07 | 68.276359 | 6962.249549 | 560000000 | 560 | | | |
| 472 | 0.472 | 0.000472 | 1.74974E-07 | 97.985521 | 9991.740341 | 560000000 | 560 | | | |
| 591 | 0.591 | 0.000591 | 2.74325E-07 | 153.62181 | 15665.06149 | 560000000 | 560 | | | |
| 787 | 0.787 | 0.000787 | 4.86451E-07 | 272.41271 | 27778.38031 | 560000000 | 560 | | | |

FIG. 12

| Wire | | | | | | | |
|---|---|---|---|---|---|---|---|
| Φ (μm) | Φ (mm) | Φ (m) | A (m²) | | L (mm) | | |
| 236 | 0.236 | 0.000236 | 4.37435E-08 | | 53 | | |
| | Martinsite | | | Austenite | | Recovery | Recovery |
| Force (N) | δ (mm) | ε (%) | 30% spring | δ (mm) | ε (%) | δm-δa mm | (%) |
| 20.0000 | 0.8654 | 1.633 | 26 | 0.4200 | 0.792 | 0.4454 | 51.47% |
| 20.0500 | 0.8676 | 1.637 | 26.065 | 0.4211 | 0.794 | 0.4465 | 51.47% |
| 20.1000 | 0.8698 | 1.641 | 26.13 | 0.4221 | 0.796 | 0.4476 | 51.47% |
| 20.1500 | 0.8719 | 1.645 | 26.195 | 0.4232 | 0.798 | 0.4488 | 51.47% |
| 20.2000 | 0.8741 | 1.649 | 26.26 | 0.4242 | 0.800 | 0.4499 | 51.47% |
| 20.2500 | 0.8763 | 1.653 | 26.325 | 0.4253 | 0.802 | 0.4510 | 51.47% |
| 20.3000 | 0.8784 | 1.657 | 26.39 | 0.4263 | 0.804 | 0.4521 | 51.47% |
| 20.3500 | 0.8806 | 1.661 | 26.455 | 0.4274 | 0.806 | 0.4532 | 51.47% |
| 20.4000 | 0.8827 | 1.666 | 26.52 | 0.4284 | 0.808 | 0.4543 | 51.47% |

FIG. 13

| Wire | | | | | | | |
|---|---|---|---|---|---|---|---|
| Φ (μm) | Φ (mm) | Φ (m) | A (m²) | | L (mm) | | |
| 236 | 0.236 | 0.000236 | 4.3744E-08 | | 53 | | |
| | Martinsite | | | Austenite | | Recovery | Recovery |
| Force (N) | δ (mm) | ε (%) | 20% spring | δ (mm) | ε (%) | δm-δa mm | (%) |
| 20.0000 | 0.8654 | 1.633 | 24 | 0.3877 | 0.732 | 0.4777 | 55.20% |
| 20.0500 | 0.8676 | 1.637 | 24.06 | 0.3887 | 0.733 | 0.4789 | 55.20% |
| 20.1000 | 0.8698 | 1.641 | 24.12 | 0.3897 | 0.735 | 0.4801 | 55.20% |
| 20.1500 | 0.8719 | 1.645 | 24.18 | 0.3906 | 0.737 | 0.4813 | 55.20% |
| 20.2000 | 0.8741 | 1.649 | 24.24 | 0.3916 | 0.739 | 0.4825 | 55.20% |
| 20.2500 | 0.8763 | 1.653 | 24.3 | 0.3926 | 0.741 | 0.4837 | 55.20% |
| 20.3000 | 0.8784 | 1.657 | 24.36 | 0.3935 | 0.743 | 0.4849 | 55.20% |
| 20.3500 | 0.8806 | 1.661 | 24.42 | 0.3945 | 0.744 | 0.4861 | 55.20% |
| 20.4000 | 0.8827 | 1.666 | 24.48 | 0.3955 | 0.746 | 0.4873 | 55.20% |

FIG. 14

Compression Springs (Power User)

| | | | | | | | | |
|---|---|---|---|---|---|---|---|---|
| End Type | Closed/Not Grou | | Condition | Not Preset/Not F | | Buckling Constaints | End fixation not | |
| Material | Music Wire | ... | Grade | Commercial | | Direction of Coiling | Optional | |
| Wire Diameter | 0.2600 | mm | Coil Mean Dia | 2.3400 | mm | Active Coils | 17.674 | |
| Wire Tolerance | 0.0102 | mm | Coil ID | 2.0800 | mm | Total Coils | 21.674 | |
| Rate | 200.000 | N/m | Coil OD | 2.6000 | mm | Dead Coils | 2.0000 | |
| Spring Index | 9.000 | | Diameter Tol. | 0.1177 | mm | Pitch | 1.1148 | mm |
| Nat. Frequency | 947.924 | Hz | Shaft OD | | mm | Pitch Angle | 8.6215 | deg |
| Wire Length | 160.7129 | mm | Min. ID | 1.9523 | mm | Free Len. Tol. | 2.1791 | mm |
| Wire Weight | 0.00007 | kg | Hole ID | | mm | Allowable Solid Ht. | | mm |
| | | | Expanded OD | 2.7428 | mm | | | |

| | Free | Point1 | Point2 | Solid | Buckle | |
|---|---|---|---|---|---|---|
| Load | 0 | 2.000 | 2.200 | 3.021 | | N |
| Load Tolerance | 0 | 0.5174 | 0.5256 | | | N |
| Length | 21.0000 | 11.0000 | 10.0000 | 5.8953 | | mm |
| Deflection | 0 | 10.0000 | 11.0000 | 15.1047 | | mm |
| % of Max. Deflection | 0 | 66.2 | 72.8 | 100 | | |
| Corrected Stress | 0 | 798 | 867 | 1190 | | MPa |
| % of Tensile Stress | 0 | 29.7 | 32.6 | 44.8 | | |

Wire Availability: No  Next Smaller Wire Size: 0.0000  Next Larger Wire Size: 0.5000

FIG. 15

Compression Springs (Power User)

| | | | | | | | | |
|---|---|---|---|---|---|---|---|---|
| End Type | Closed/Ground | | Condition | Not Preset/Not F | | Buckling Constaints | End fixation not | |
| Material | Music Wire | ... | Grade | Commercial | | Direction of Coiling | Optional | |
| Wire Diameter | 0.2600 | mm | Coil Mean Dia | 2.3400 | mm | Active Coils | 17.674 | |
| Wire Tolerance | 0.0102 | mm | Coil ID | 2.0800 | mm | Total Coils | 21.674 | |
| Rate | 200.000 | N/m | Coil OD | 2.6000 | mm | Dead Coils | 2.0000 | |
| Spring Index | 9.000 | | Diameter Tol. | 0.1177 | mm | Pitch | 1.1293 | mm |
| Nat. Frequency | 947.924 | Hz | Shaft OD | | mm | Pitch Angle | 8.7336 | deg |
| Wire Length | 160.7129 | mm | Min. ID | 1.9623 | mm | Free Len. Tol. | 1.2818 | mm |
| Wire Weight | 0.00007 | kg | Hole ID | | mm | Allowable Solid Ht. | | mm |
| | | | Expanded OD | 2.7435 | mm | | | |

| | Free | Point1 | Point2 | Solid | Buckle | |
|---|---|---|---|---|---|---|
| Load | 0 | 2.400 | 2.600 | 3.073 | | N |
| Load Tolerance | 0 | 0.3140 | 0.3188 | | | N |
| Length | 21.0000 | 9.0000 | 8.0000 | 5.6353 | | mm |
| Deflection | 0 | 12.0000 | 13.0000 | 15.3647 | | mm |
| % of Max. Deflection | 0 | 78.1 | 84.6 | 100 | | |
| Corrected Stress | 0 | 946 | 1024 | 1211 | | MPa |
| % of Tensile Stress | 0 | 35.6 | 38.6 | 45.6 | | |

| | | | | | |
|---|---|---|---|---|---|
| Wire Availability | No | Next Smaller Wire Size | 0.0000 | Next Larger Wire Size | 0.5000 |

FIG. 16

Calculations for Flexinol

Deflection Force(F) for given Stain(ε) and wire size (cross sectional area).

| | | | | | | | | | | | |
|---|---|---|---|---|---|---|---|---|---|---|---|
| 3 | 3mm | 0.44 | | E(martinsite phase) | | 28 | GPa | E(austinite phase) | | 75 | GPa |
| 4 | | | | | | 28000000000 | Pa | | | 75000000000 | Pa |
| 5 | | | | | | | | | | | |
| 6 | ε% | 2 | 0.02 | | L(mm) | 50 | | | | | |
| 7 | | σ(MPa) | 560 | | | | | | | | |
| 8 | Φ (μm) | Φ (mm) | Φ (m) | A($m^2$) | F(N) | F(g) | σ(Pa) | σ(MPa) | | | |
| 9 | 236 | 0.236 | 0.000236 | 4.37425E-08 | 24.49638 | 2497.935085 | 560000000 | 560 | | | |
| 10 | 314 | 0.314 | 0.000314 | 7.74371E-08 | 43.364786 | 4421.976581 | 560000000 | 560 | | | |
| 11 | 394 | 0.394 | 0.000394 | 1.21922E-07 | 68.276359 | 6962.249549 | 560000000 | 560 | | | |
| 12 | 472 | 0.472 | 0.000472 | 1.74974E-07 | 97.985521 | 9991.740341 | 560000000 | 560 | | | |
| 13 | 591 | 0.591 | 0.000591 | 2.74325E-07 | 153.62181 | 15665.06149 | 560000000 | 560 | | | |
| 14 | 787 | 0.787 | 0.000787 | 4.86451E-07 | 272.41271 | 27778.36031 | 560000000 | 560 | | | |
| 15 | | | | | | | | | | | |
| 16 | | | | | | | | | | | |
| 17 | E(martinsite phase) | | 28 | GPa | E(austinite phase) | | 75 | GPa | | | |
| 18 | | | 28000000000 | Pa | | | 75000000000 | Pa | | | |

Wire

| | | | | | | | | | |
|---|---|---|---|---|---|---|---|---|---|
| 20 | Φ (μm) | Φ (mm) | Φ (m) | A($m^2$) | | L(mm) | | | |
| 21 | 236 | 0.236 | 0.000236 | 4.37425E-08 | | 50 | | | |
| 22 | | Martinsite | | | Austenite | | | Recovery | Recovery |
| 23 | Force (N) | δ (mm) | ε (%) | 10%spring | δ (mm) | ε (%) | | δm-δamm | (%) |
| 24 | 20.0000 | 0.8164 | 1.633 | 22 | 0.3353 | 0.671 | | 0.4812 | 58.93% |
| 25 | 20.0500 | 0.8185 | 1.637 | 22.055 | 0.3361 | 0.672 | | 0.4824 | 58.93% |
| 26 | 20.1000 | 0.8205 | 1.641 | 22.11 | 0.3370 | 0.674 | | 0.4836 | 58.93% |
| 27 | 20.1500 | 0.8226 | 1.645 | 22.165 | 0.3378 | 0.676 | | 0.4848 | 58.93% |
| 28 | 20.2000 | 0.8246 | 1.649 | 22.22 | 0.3386 | 0.677 | | 0.4860 | 58.93% |
| 29 | 20.2500 | 0.8267 | 1.652 | 22.275 | 0.3395 | 0.679 | | 0.4872 | 58.93% |
| 30 | 20.3000 | 0.8287 | 1.657 | 22.33 | 0.3403 | 0.681 | | 0.4884 | 58.93% |
| 31 | 20.3500 | 0.8307 | 1.661 | 22.385 | 0.3412 | 0.682 | | 0.4896 | 58.93% |
| 32 | 20.4000 | 0.8327 | 1.666 | 22.44 | 0.3420 | 0.684 | | 0.4908 | 58.93% |
| 33 | 20.4500 | 0.8348 | 1.670 | 22.495 | 0.3428 | 0.686 | | 0.4920 | 58.93% |
| 34 | 20.5000 | 0.8368 | 1.674 | 22.55 | 0.3437 | 0.687 | | 0.4932 | 58.93% |
| 35 | 20.5500 | 0.8389 | 1.678 | 22.605 | 0.3445 | 0.689 | | 0.4944 | 58.93% |
| 36 | 20.6000 | 0.8409 | 1.682 | 22.66 | 0.3453 | 0.691 | | 0.4956 | 58.93% |
| 37 | 20.6500 | 0.8430 | 1.686 | 22.715 | 0.3462 | 0.692 | | 0.4968 | 58.93% |
| 38 | 20.7000 | 0.8450 | 1.690 | 22.77 | 0.3470 | 0.694 | | 0.4980 | 58.93% |
| 39 | 20.7500 | 0.8471 | 1.694 | 22.825 | 0.3479 | 0.696 | | 0.4992 | 58.93% |
| 40 | 20.8000 | 0.8491 | 1.698 | 22.88 | 0.3487 | 0.697 | | 0.5004 | 58.93% |
| 41 | 20.8500 | 0.8511 | 1.702 | 22.935 | 0.3495 | 0.699 | | 0.5016 | 58.93% |
| 42 | 20.9000 | 0.8532 | 1.706 | 22.99 | 0.3504 | 0.701 | | 0.5028 | 58.93% |
| 43 | 20.9500 | 0.8552 | 1.710 | 23.045 | 0.3512 | 0.702 | | 0.5040 | 58.93% |
| 44 | 21.0000 | 0.8573 | 1.715 | 23.1 | 0.3521 | 0.704 | | 0.5052 | 58.93% |
| 45 | 21.0500 | 0.8593 | 1.719 | 23.155 | 0.3529 | 0.706 | | 0.5064 | 58.93% |
| 46 | 21.1000 | 0.8614 | 1.723 | 23.21 | 0.3537 | 0.707 | | 0.5076 | 58.93% |
| 47 | 21.1500 | 0.8634 | 1.727 | 23.265 | 0.3546 | 0.709 | | 0.5088 | 58.93% |
| 48 | 21.2000 | 0.8654 | 1.731 | 23.32 | 0.3554 | 0.711 | | 0.5100 | 58.93% |
| 49 | 21.2500 | 0.8675 | 1.735 | 23.375 | 0.3562 | 0.712 | | 0.5112 | 58.93% |
| 50 | 21.3000 | 0.8695 | 1.739 | 23.43 | 0.3571 | 0.714 | | 0.5124 | 58.93% |
| 51 | 21.3500 | 0.8716 | 1.743 | 23.485 | 0.3579 | 0.716 | | 0.5136 | 58.93% |
| 52 | 21.4000 | 0.8736 | 1.747 | 23.54 | 0.3588 | 0.718 | | 0.5148 | 58.93% |
| 53 | 21.4500 | 0.8756 | 1.751 | 23.595 | 0.3596 | 0.719 | | 0.5160 | 58.93% |
| 54 | 21.5000 | 0.8777 | 1.755 | 23.65 | 0.3604 | 0.721 | | 0.5172 | 58.93% |
| 55 | 21.5500 | 0.8797 | 1.759 | 23.705 | 0.3613 | 0.723 | | 0.5184 | 58.93% |
| 56 | 21.6000 | 0.8818 | 1.764 | 23.76 | 0.3621 | 0.724 | | 0.5197 | 58.93% |
| 57 | 21.6500 | 0.8838 | 1.768 | 23.815 | 0.3629 | 0.726 | | 0.5209 | 58.93% |
| 58 | 21.7000 | 0.8858 | 1.772 | 23.87 | 0.3638 | 0.728 | | 0.5221 | 58.93% |
| 59 | 21.7500 | 0.8879 | 1.776 | 23.925 | 0.3646 | 0.729 | | 0.5233 | 58.93% |
| 60 | 21.8000 | 0.8899 | 1.780 | 23.98 | 0.3655 | 0.731 | | 0.5245 | 58.93% |
| 61 | 21.8500 | 0.8920 | 1.784 | 24.035 | 0.3663 | 0.733 | | 0.5257 | 58.93% |
| 62 | 21.9000 | 0.8940 | 1.788 | 24.09 | 0.3671 | 0.734 | | 0.5269 | 58.93% |
| 63 | 21.9500 | 0.8961 | 1.792 | 24.145 | 0.3680 | 0.736 | | 0.5281 | 58.93% |
| 64 | 22.0000 | 0.8981 | 1.796 | 24.2 | 0.3688 | 0.738 | | 0.5293 | 58.93% |

Wire

| | | | | | | | | |
|---|---|---|---|---|---|---|---|---|
| Φ (μm) | Φ (mm) | Φ (m) | A($m^2$) | | L(mm) | | | |
| 236 | 0.236 | 0.000236 | 4.374E-08 | | 53 | | | |
| | Martinsite | | | Austenite | | | Recovery | Recovery |
| Force(N) | δ (mm) | ε (%) | 20%spring | δ (mm) | ε (%) | | δm-δamm | (%) |
| 20.0000 | 0.8654 | 1.633 | 24 | 0.3877 | 0.732 | | 0.4777 | 55.20% |
| 20.0500 | 0.8676 | 1.637 | 24.06 | 0.3887 | 0.733 | | 0.4789 | 55.20% |
| 20.1000 | 0.8698 | 1.641 | 24.12 | 0.3897 | 0.735 | | 0.4801 | 55.20% |
| 20.1500 | 0.8719 | 1.645 | 24.18 | 0.3906 | 0.737 | | 0.4813 | 55.20% |
| 20.2000 | 0.8741 | 1.649 | 24.24 | 0.3916 | 0.739 | | 0.4825 | 55.20% |
| 20.2500 | 0.8762 | 1.652 | 24.3 | 0.3926 | 0.741 | | 0.4837 | 55.20% |
| 20.3000 | 0.8784 | 1.657 | 24.36 | 0.3935 | 0.743 | | 0.4849 | 55.20% |
| 20.3500 | 0.8806 | 1.661 | 24.42 | 0.3945 | 0.744 | | 0.4861 | 55.20% |
| 20.4000 | 0.8827 | 1.666 | 24.48 | 0.3955 | 0.746 | | 0.4873 | 55.20% |
| 20.4500 | 0.8849 | 1.670 | 24.54 | 0.3964 | 0.748 | | 0.4885 | 55.20% |
| 20.5000 | 0.8871 | 1.674 | 24.6 | 0.3974 | 0.750 | | 0.4897 | 55.20% |
| 20.5500 | 0.8892 | 1.678 | 24.66 | 0.3984 | 0.752 | | 0.4909 | 55.20% |
| 20.6000 | 0.8914 | 1.682 | 24.72 | 0.3993 | 0.753 | | 0.4921 | 55.20% |
| 20.6500 | 0.8936 | 1.686 | 24.78 | 0.4003 | 0.755 | | 0.4933 | 55.20% |
| 20.7000 | 0.8957 | 1.690 | 24.84 | 0.4013 | 0.757 | | 0.4944 | 55.20% |
| 20.7500 | 0.8979 | 1.694 | 24.9 | 0.4023 | 0.759 | | 0.4956 | 55.20% |
| 20.8000 | 0.9001 | 1.698 | 24.96 | 0.4032 | 0.761 | | 0.4968 | 55.20% |
| 20.8500 | 0.9022 | 1.702 | 25.02 | 0.4042 | 0.763 | | 0.4980 | 55.20% |
| 20.9000 | 0.9044 | 1.706 | 25.08 | 0.4052 | 0.764 | | 0.4992 | 55.20% |
| 20.9500 | 0.9065 | 1.710 | 25.14 | 0.4061 | 0.766 | | 0.5004 | 55.20% |
| 21.0000 | 0.9087 | 1.715 | 25.2 | 0.4071 | 0.768 | | 0.5016 | 55.20% |
| 21.0500 | 0.9109 | 1.719 | 25.26 | 0.4081 | 0.770 | | 0.5028 | 55.20% |
| 21.1000 | 0.9130 | 1.723 | 25.32 | 0.4090 | 0.772 | | 0.5040 | 55.20% |
| 21.1500 | 0.9152 | 1.727 | 25.38 | 0.4100 | 0.774 | | 0.5052 | 55.20% |
| 21.2000 | 0.9174 | 1.731 | 25.44 | 0.4110 | 0.775 | | 0.5064 | 55.20% |
| 21.2500 | 0.9195 | 1.735 | 25.5 | 0.4119 | 0.777 | | 0.5076 | 55.20% |
| 21.3000 | 0.9217 | 1.739 | 25.56 | 0.4129 | 0.779 | | 0.5088 | 55.20% |
| 21.3500 | 0.9239 | 1.743 | 25.62 | 0.4139 | 0.781 | | 0.5100 | 55.20% |
| 21.4000 | 0.9260 | 1.747 | 25.68 | 0.4149 | 0.782 | | 0.5112 | 55.20% |
| 21.4500 | 0.9282 | 1.751 | 25.74 | 0.4158 | 0.785 | | 0.5124 | 55.20% |
| 21.5000 | 0.9303 | 1.755 | 25.8 | 0.4168 | 0.786 | | 0.5135 | 55.20% |
| 21.5500 | 0.9325 | 1.759 | 25.86 | 0.4178 | 0.788 | | 0.5147 | 55.20% |
| 21.6000 | 0.9347 | 1.764 | 25.92 | 0.4187 | 0.790 | | 0.5159 | 55.20% |
| 21.6500 | 0.9368 | 1.768 | 25.98 | 0.4197 | 0.792 | | 0.5171 | 55.20% |
| 21.7000 | 0.9390 | 1.772 | 26.04 | 0.4207 | 0.794 | | 0.5183 | 55.20% |
| 21.7500 | 0.9412 | 1.776 | 26.1 | 0.4216 | 0.796 | | 0.5195 | 55.20% |
| 21.8000 | 0.9433 | 1.780 | 26.16 | 0.4226 | 0.797 | | 0.5207 | 55.20% |
| 21.8500 | 0.9455 | 1.784 | 26.22 | 0.4236 | 0.799 | | 0.5219 | 55.20% |
| 21.9000 | 0.9477 | 1.788 | 26.28 | 0.4245 | 0.801 | | 0.5231 | 55.20% |
| 21.9500 | 0.9498 | 1.792 | 26.34 | 0.4255 | 0.803 | | 0.5242 | 55.20% |
| 22.0000 | 0.9520 | 1.796 | 26.4 | 0.4265 | 0.805 | | 0.5255 | 55.20% |

Wire

| | | | | | | | | |
|---|---|---|---|---|---|---|---|---|
| Φ (μm) | Φ (mm) | Φ (m) | A($m^2$) | | L(mm) | | | |
| 236 | 0.236 | 0.000236 | 4.374E-08 | | 53 | | | |
| | Martinsite | | | Austenite | | | Recovery | Recovery |
| Force(N) | δ (mm) | ε (%) | 20%spring | δ (mm) | ε (%) | | δm-δamm | (%) |
| 20.0000 | 0.8654 | 1.633 | 26 | 0.4209 | 0.792 | | 0.4454 | 51.47% |
| 20.0500 | 0.8676 | 1.637 | 26.065 | 0.4211 | 0.794 | | 0.4465 | 51.47% |
| 20.1000 | 0.8698 | 1.641 | 26.13 | 0.4221 | 0.796 | | 0.4476 | 51.47% |
| 20.1500 | 0.8719 | 1.645 | 26.195 | 0.4232 | 0.798 | | 0.4488 | 51.47% |
| 20.2000 | 0.8741 | 1.649 | 26.26 | 0.4242 | 0.800 | | 0.4499 | 51.47% |
| 20.2500 | 0.8762 | 1.652 | 26.325 | 0.4252 | 0.802 | | 0.4510 | 51.47% |
| 20.3000 | 0.8784 | 1.657 | 26.39 | 0.4263 | 0.804 | | 0.4521 | 51.47% |
| 20.3500 | 0.8806 | 1.661 | 26.455 | 0.4274 | 0.806 | | 0.4532 | 51.47% |
| 20.4000 | 0.8827 | 1.666 | 26.52 | 0.4284 | 0.808 | | 0.4543 | 51.47% |
| 20.4500 | 0.8849 | 1.670 | 26.585 | 0.4295 | 0.810 | | 0.4554 | 51.47% |
| 20.5000 | 0.8871 | 1.674 | 26.65 | 0.4305 | 0.812 | | 0.4565 | 51.47% |
| 20.5500 | 0.8892 | 1.678 | 26.715 | 0.4316 | 0.814 | | 0.4577 | 51.47% |
| 20.6000 | 0.8914 | 1.682 | 26.78 | 0.4326 | 0.816 | | 0.4588 | 51.47% |
| 20.6500 | 0.8936 | 1.686 | 26.845 | 0.4337 | 0.818 | | 0.4599 | 51.47% |
| 20.7000 | 0.8957 | 1.690 | 26.91 | 0.4347 | 0.820 | | 0.4610 | 51.47% |
| 20.7500 | 0.8979 | 1.694 | 26.975 | 0.4358 | 0.822 | | 0.4621 | 51.47% |
| 20.8000 | 0.9001 | 1.698 | 27.04 | 0.4368 | 0.824 | | 0.4632 | 51.47% |
| 20.8500 | 0.9022 | 1.702 | 27.105 | 0.4379 | 0.826 | | 0.4643 | 51.47% |
| 20.9000 | 0.9044 | 1.706 | 27.17 | 0.4389 | 0.828 | | 0.4655 | 51.47% |
| 20.9500 | 0.9065 | 1.710 | 27.235 | 0.4400 | 0.830 | | 0.4666 | 51.47% |
| 21.0000 | 0.9087 | 1.715 | 27.3 | 0.4410 | 0.832 | | 0.4677 | 51.47% |
| 21.0500 | 0.9109 | 1.719 | 27.365 | 0.4421 | 0.834 | | 0.4688 | 51.47% |
| 21.1000 | 0.9130 | 1.723 | 27.43 | 0.4431 | 0.836 | | 0.4699 | 51.47% |
| 21.1500 | 0.9152 | 1.727 | 27.495 | 0.4442 | 0.838 | | 0.4710 | 51.47% |
| 21.2000 | 0.9174 | 1.731 | 27.56 | 0.4452 | 0.840 | | 0.4721 | 51.47% |
| 21.2500 | 0.9195 | 1.735 | 27.625 | 0.4463 | 0.842 | | 0.4732 | 51.47% |
| 21.3000 | 0.9217 | 1.739 | 27.69 | 0.4473 | 0.844 | | 0.4744 | 51.47% |
| 21.3500 | 0.9239 | 1.743 | 27.755 | 0.4484 | 0.846 | | 0.4755 | 51.47% |
| 21.4000 | 0.9260 | 1.747 | 27.82 | 0.4494 | 0.848 | | 0.4766 | 51.47% |
| 21.4500 | 0.9282 | 1.751 | 27.885 | 0.4505 | 0.850 | | 0.4777 | 51.47% |
| 21.5000 | 0.9303 | 1.755 | 27.95 | 0.4515 | 0.852 | | 0.4788 | 51.47% |
| 21.5500 | 0.9325 | 1.759 | 28.015 | 0.4526 | 0.854 | | 0.4799 | 51.47% |
| 21.6000 | 0.9347 | 1.764 | 28.08 | 0.4536 | 0.856 | | 0.4810 | 51.47% |
| 21.6500 | 0.9368 | 1.768 | 28.145 | 0.4547 | 0.858 | | 0.4822 | 51.47% |
| 21.7000 | 0.9390 | 1.772 | 28.21 | 0.4557 | 0.860 | | 0.4833 | 51.47% |
| 21.7500 | 0.9412 | 1.776 | 28.275 | 0.4568 | 0.862 | | 0.4844 | 51.47% |
| 21.8000 | 0.9433 | 1.780 | 28.34 | 0.4578 | 0.864 | | 0.4855 | 51.47% |
| 21.8500 | 0.9455 | 1.784 | 28.405 | 0.4589 | 0.866 | | 0.4866 | 51.47% |
| 21.9000 | 0.9477 | 1.788 | 28.47 | 0.4599 | 0.868 | | 0.4877 | 51.47% |
| 21.9500 | 0.9498 | 1.792 | 28.535 | 0.4610 | 0.870 | | 0.4888 | 51.47% |
| 22.0000 | 0.9520 | 1.796 | 28.6 | 0.4620 | 0.872 | | 0.4900 | 51.47% |

FIG. 17

ROTARY CONTROL WITH HAPTIC EFFECTS AND METHOD OF MANUFACTURING THEREOF

FIELD OF THE INVENTION

The invention relates to systems with haptic effects. In particular, the invention relates to controllers with haptic feedback.

BACKGROUND OF THE INVENTION

In many different applications, electrical input devices have replaced mechanical input devices because the electrical input devices have fewer moving components. With fewer moving components, electrical input devices are less likely to fail due to wear and thus are more reliable. However, electrical input devices lack the tactile feedback provided by the interaction of moving parts within mechanical input devices. Thus, electrical input devices rely on visual, auditory, kinesthetic, and/or tactile cues to provide feedback to the user. Kinesthetic feedback (such as active and resistive force feedback) and tactile feedback (such as vibration, texture, and heat) are collectively referred to as "haptic feedback." Haptic feedback can be used to convey physical force sensations to the user, and generally, the physical forces simulate actuating a traditional mechanical button or switch and provide the user with an indication that the user's input has been accepted.

In automotive applications, electrical input devices are often used in place of mechanical input devices in systems, such as audio systems, heating and cooling systems, navigation systems, lighting systems, and other systems. In many cases, the electrical input device replaces a mechanical rotary switch. Thus, the electrical rotary switch must feel and respond like the traditional mechanical rotary switch that it replaces. The mechanical feel and response is simulated by haptic feedback.

Haptic feedback in electrical rotary switches can be provided in several different ways. First, the torque versus displacement of the rotary switch, also known as the detent amplitude, can be varied so that the torque required to turn the electrical rotary switch can become smaller or larger as the switch is rotated. Second, the allowable displacement of the electrical rotary switch can be varied so that the rotary switch allows only partial rotation (rotates less than 360°) or allows continuous rotation (rotates more than 360°). Third, the number of detents per possible rotation of the electrical rotary switch can be varied. And lastly, the background friction torque of the electrical rotary switch can be varied to make the rotary switch easier or harder to rotate.

Haptic feedback in a rotary switch is provided through a knob that is assembled to an encoder. The encoder can have separate detent and spring members or a combined detent and spring member. Generally, haptic feedback is provided by a detent profile, or a cam surface, that acts upon the detent, or a cam follower, which changes the compression of the spring member. Also, it is desirable to have variable tactile effects, i.e., a different feel for different functions. Such variable tactile effects are provided by programmable rotary controls that have an electromechanical device, such as a DC motor or electro-magnetic clutch break. Programmable rotary controls with an electromechanical device provide a near infinite variety of tactile effects. However, in most applications, a near infinite variety of tactile effects is unnecessary, and only a few different kinds of tactile effects are required. Thus, a user that needs, for example, only two or three different tactile effects has to acquire a more costly rotary switch with a near infinite number of tactile effects.

Thus, there is a need for a rotary switch assembly with adjustable and variable haptic effects. Also, there is a need for a rotary switch assembly with fewer options for haptic effects, thus reducing manufacturing costs of the rotary switch assembly.

SUMMARY OF THE INVENTION

Accordingly, an object of the invention is to provide a rotary switch assembly with variable and adjustable haptic feedback at reduced cost.

One embodiment of the invention provides a rotary switch assembly. The rotary switch assembly includes a knob, a wheel joined to the knob, a first frame that moves toward the wheel, a second frame joined to the first frame, and a shape memory alloy member made from a shape memory alloy and joined to the second frame. The shape memory alloy member changes shape, and the second frame transforms the changing shape of the shape memory alloy member into movement of the first frame.

Another embodiment of the invention provides a method of manufacturing a rotary switch assembly. The method of manufacturing includes the steps of: providing a shape memory alloy member made from a shape memory alloy; providing an extendable frame; joining the shape memory alloy member to the extendable frame such that the changing shape of the shape memory alloy member extends the extendable frame; providing a surface that engages the extendable frame; placing the surface a predetermined distance away from the extendable frame; and joining the extendable frame to the surface such that extending the extendable frame causes the extendable frame to engage the surface.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 12 is a chart with data for deflection force for a given strain and a cross-sectional area of the shape memory alloy member illustrated in FIG. 1;

FIG. 13 is a chart with data for an approximately 30% increase in a spring load on the plunger-spring assembly of the rotary switch assembly illustrated in FIG. 1;

FIG. 14 is a chart with data for an approximately 20% increase in a spring load on the plunger-spring assembly of the rotary switch assembly illustrated in FIG. 1;

FIG. 15 is data for wire that can be used with the shape memory alloy member illustrated in FIG. 1;

FIG. 16 is data for wire that can be used with the shape memory alloy member illustrated in FIG. 1;

FIG. 17 is a chart with data for a flexinol wire that can be used the shape memory alloy member illustrated in FIG. 1;

DETAILED DESCRIPTION OF THE INVENTION

Referring to FIGS. 1 to 27, the invention provides a rotary switch assembly 100 with variable and adjustable haptic effects. Haptic effects are provided by use of a shape memory alloy (SMA). The SMA can change the torque versus displacement (the detent amplitude) of the rotary switch assembly 100, the allowable displacement of the rotary switch assembly 100, the number of detents per allowable displacement, the background friction of the rotary switch assembly 100, some combination of the aforementioned, or some other attribute of the rotary switch assembly 100. The SMA also allows shifting from one haptic effect to another. Furthermore, the SMA lowers the overall cost of the rotary switch assembly 100.

Figure 1:
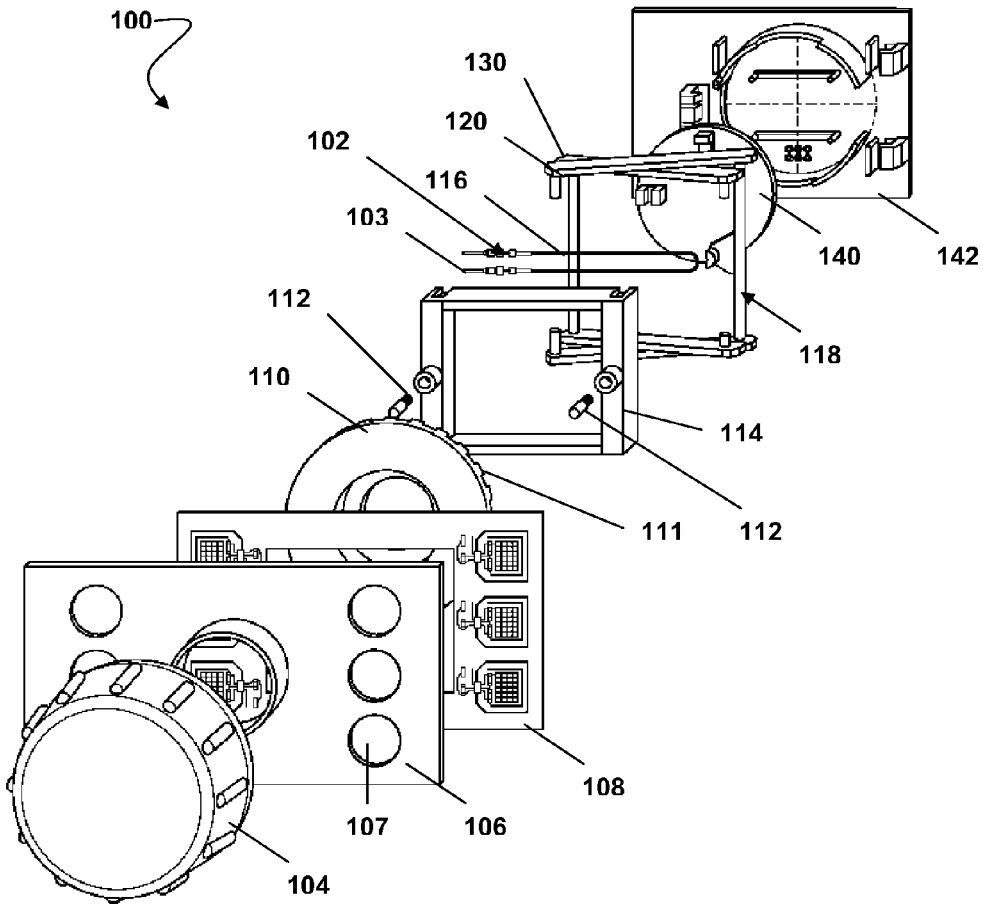
FIG. 1 is an exploded perspective of a rotary switch assembly with haptic effects according to an exemplary embodiment of the invention.

Referring to FIG. 1, an embodiment of the rotary switch assembly 100 is shown in an exploded perspective view. The rotary switch assembly 100 includes, at least, an SMA member 102 that provides a variety of haptic effects through interaction with other parts of the rotary switch assembly 100. The SMA member 102 as shown includes a nitinol wire assembly 116. Also, in the embodiment shown, the rotary switch assembly 100 includes a knob 104, a bezel 106, a touch panel 108, a wheel 110, a spring-plunger assembly 112, a first frame 114, a second frame 118, an encoding circuit board 140, and a base 142. Although the embodiment shown is a rotary switch assembly 100, the invention is not limited to only rotary switch assemblies. In the interest of simplifying and facilitating the description of the invention without intending to limit the invention, an exemplary embodiment utilizing a rotary switch assembly 100 is described.

The SMA member 102 provides a variety of haptic effects that include, at least, varying the torque versus displacement (the detent amplitude) of the rotary switch assembly 100, changing the allowable displacement of the rotary switch assembly 100, adjusting the number of detents per allowable displacement of the rotary switch assembly 100, and modifying the background friction of the rotary switch assembly 100. The SMA member 102 provides various haptic effects by having a shape memory alloy. Shape memory alloys, also known as smart alloys or memory metals, are alloys that "remember" their shape, and after deforming an object made from shape memory alloy, it can be returned to substantially its original shape by applying heat to the alloy. Shape memory alloys include copper-zinc-aluminum-nickel, copper-aluminum-nickel, and nickel-titanium (NiTi) alloys. When a shape memory alloy is below the transition temperature or its "cold state," the shape memory alloy can be bent or stretched into a variety of new shapes and holds that shape until it is heated above the transition temperature. Upon heating, the shape memory alloy returns substantially to its original shape, regardless of the shape it was when it was in its cold state. When the shape memory alloy cools again, it remains in the "hot shape" until it is deformed again.

NiTi alloys change from austenite to martensite upon cooling, and during heating, NiTi alloys transform from martensite to austenite. The special properties of NiTi alloys arise from the reversible diffusionless transition between these two phases. Whereas in carbon steel, although martensite can be formed from austenite by rapid cooling, the process is not reversible, and thus carbon steel does not have shape memory properties. The transition from the martensite phase to the austenite phase is only dependent on temperature and stress but not time, as most phase changes are, because no diffusion is involved. The transition point can also be controlled electrically. NiTi alloy is commercially available as nitinol, and nitinol wires and other shapes are also commercially available.

In the embodiment shown, the SMA member 102 includes couplings 103 for mating with an electrical source (not shown). Thus, when an electrical current passes through the nitinol wire assembly 116 of the SMA member 102, the nitinol wire assembly 116 heats up because of its inherent electrical resistance to the flow of current. Therefore, the SMA member 102 can be deformed when it is below its transition temperature and then return substantially to its original, undeformed shape after being heated by the electrical current. The transitioning between deformed and original shape can be used, either directly or through another structure, such as the second frame 118, to provide a variety of haptic effects. In the embodiment shown, the nitinol wire assembly 116 of the SMA member 102 interacts with the second frame 118.

The user rotates the knob 104 to provide an input to the rotary switch assembly 100, and the input is used to control a device controlled by the rotary switch assembly 100. In other embodiments, the knob 104 can be a flip switch, push switch, pull switch, or some other input device that can be implemented with the rotary switch assembly 100. The knob 104 is shown with a substantially cylindrical shape, but in alternate embodiments, the shape can be some other suitable shape that the user can manipulate. For example, the knob 104 can be substantially a cube, a tetrahedron, or some other shape. The knob 104 is made of a suitably rigid material, such as plastic, glass, metal, wood, leather, combinations of the aforementioned, or some other rigid material. Furthermore, the knob 104 can be marked with words, letters, numbers, figures, or other insignia.

The bezel 106 provides an external surface for the rotary switch assembly 100. The bezel 102 can be decorative, provide protection for inner components, or provide mechanical support to another component. The bezel 102 can also include at least one input device 107. The input device 107 can be pressure sensitive through resistive sensors, electrically sensitive through capacitive sensors, acoustically sensitive through surface acoustic wave sensors, photo sensitive through infrared sensors, and the like. In the embodiment shown, the input device 107 can be depressed by the user. In other embodiments, the input device 107 can be a switch, another rotary knob, pull switch, or some other input device that can be implemented with the rotary switch assembly 100. The bezel 106 is made from a suitably rigid material, such as plastic, glass, metal, wood, leather, combinations of the aforementioned, and the like. The bezel 106 can be marked with words, letters, numbers, figures, or other insignia. Furthermore, although the depicted embodiment has a bezel 106, in other embodiments, the bezel 106 can be replaced with a touch screen, one or more touch switches, one or more touch pads, and other similar devices that can accept an input from a user. The touch screen, touch switches, touch pads, and the like can be made transparent or translucent and placed over a display device that generates graphical images. The display device can be a liquid crystal display, a plasma display, an electroluminescent display, a light emitting diode display, or some other device for displaying images, such that the user responds to the images to provide an input to the rotary switch assembly 100 instead of the insignia of a bezel 106.

The touch pad 108 is disposed behind the bezel 106. The touch pad 108 includes the corresponding and necessary electrical components, electronics, mechanical components, and other devices that interact with the input device 107 to transform the user's input into an electrical, electro-mechanical, or mechanical signal suitable for use by the rotary switch assembly 100. The touch pad 108 can be made from a suitable material that provides mechanical support and a mounting surface for the electrical components, electronics, mechanical components, and other devices necessary for the input device 107. The touch pad 107 of the depicted embodiment is disposed immediately adjacent to a surface of the bezel 106 opposite the surface with the input devices 107. Also, in the embodiment shown, the touch pad 107 is a dielectric substrate with electronics on the substrate to transform the depressing of an input device 107 into an electrical signal.

Disposed behind the touch pad 108 is a wheel 110. The wheel 110 is coupled to the knob 104 so that, when the user rotates the knob 104, the wheel 110 also rotates. The wheel 110 is made from a suitably rigid material. The wheel 110 can include detents 111. The detents 111 can be used with other components of the rotary switch assembly 100 to change the operational torque, the allowed displacement, the number of detents per allowed displacement, the background friction, or some other attribute of the rotary switch assembly 100.

The first frame 114 is placed adjacent the wheel 110. The first frame 114 can mechanically support other components that interact with the wheel 110 to provide haptic effects to the rotary switch assembly 100. In the embodiment shown, the first frame 114 includes a plunger-spring assembly 112. The plunger-spring assembly 112 interacts with the wheel 110 to change the operational torque or the detent amplitude of the knob 104. In another embodiment, the first frame 114 can include portions of a clutch type friction interface that interacts with the wheel 110 to change the background friction of the knob 104. The first frame 114 can also include a stop frame pin that interacts with the detents 111 of the wheel 110 to limit the total rotational travel of the knob 104.

Figure 2:
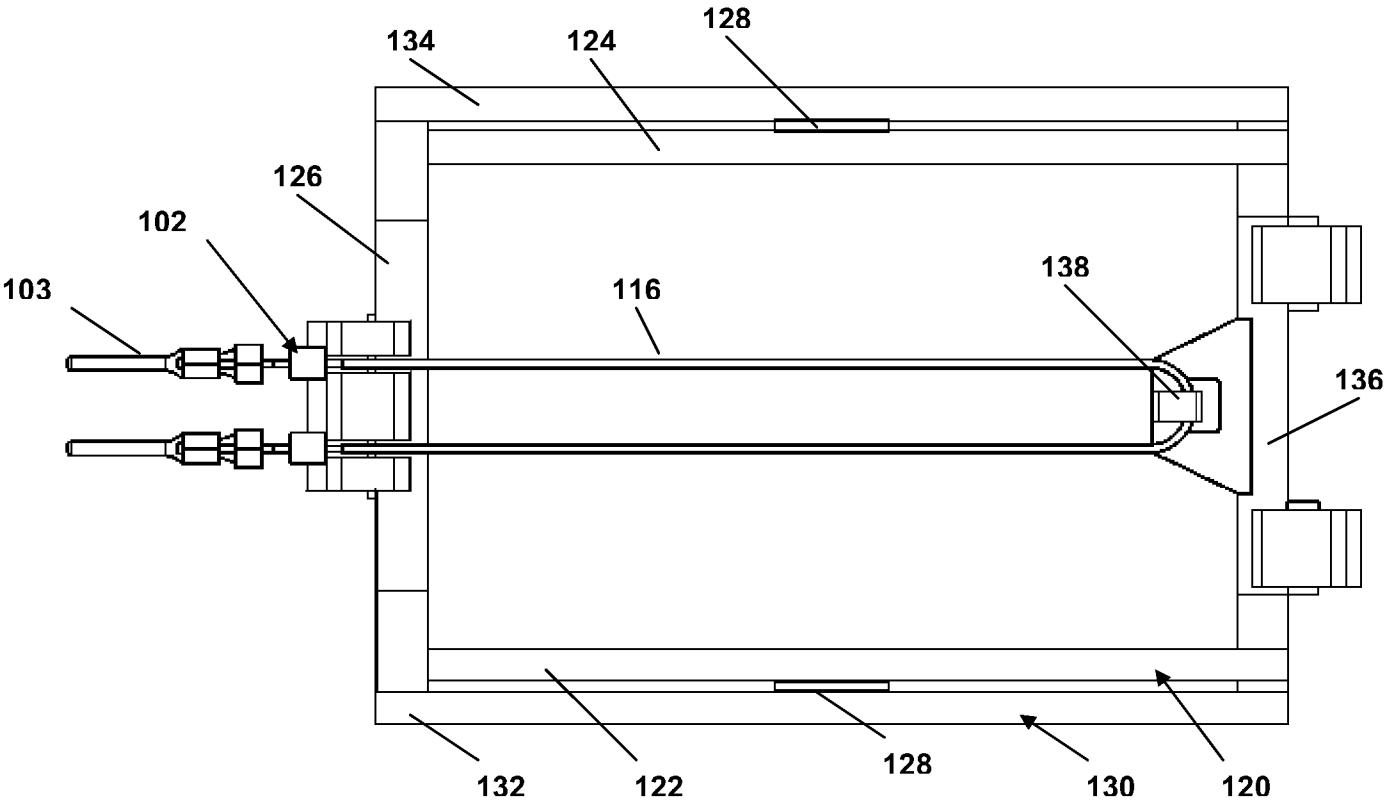
FIG. 2 is an overhead plan view of a shape memory alloy member and a second frame of the rotary switch assembly illustrated in FIG. 1.
Figure 3:
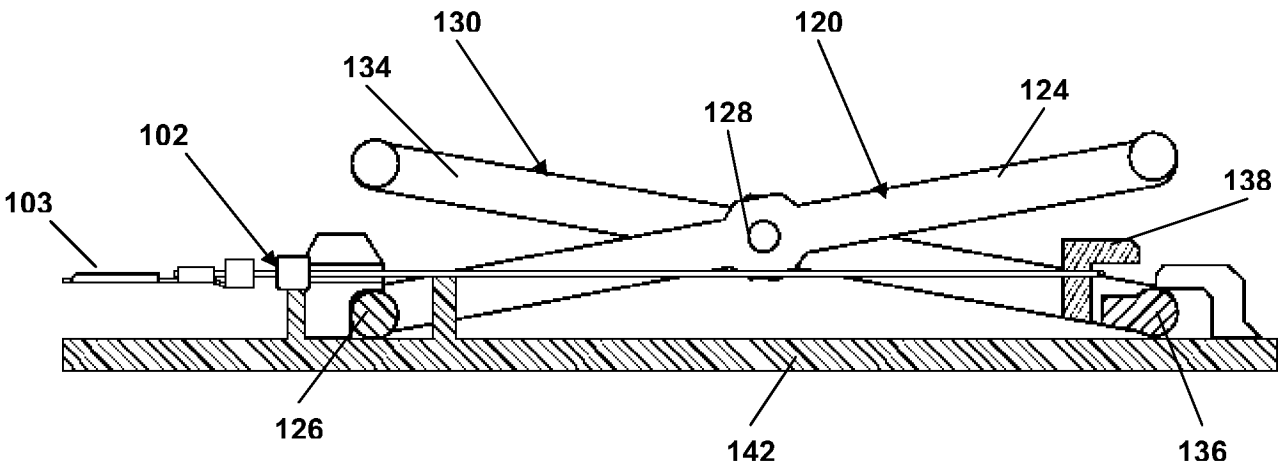
FIG. 3 is a side elevational of the shape memory alloy member and the second frame illustrated in FIG. 2.

Adjacent to the first frame 114 is the second frame 118 with the SMA member 102. The SMA member 102 interacts with the second frame 118, and the second frame 118 mechanically transforms the changing shape of the SMA member 102 into a motion or a mechanical force. In the embodiment shown, the resulting motion or mechanical force affects the first frame 114. Also, in embodiment shown, the second frame 118 is a scissor frame that pushes, lifts, or expands towards the first frame 114 as the SMA member 102 changes shape. As best seen in FIGS. 2 and 3, the second frame 118 includes at least two substantially U-shaped members 120 and 130. The first substantially U-shaped member 120 has legs 122 and 124 with a bridging portion 126 between the legs 122 and 124. The second substantially U-shaped member 130 has legs 132 and 134 with a bridging portion 136 between the legs 132 and 134. The legs 122 and 124 of the first substantially U-shaped member 120 are disposed within the legs 132 and 134 of the second substantially U-shaped members 130, with their respective bridging portions 126 and 136 disposed adjacent the distal ends of the legs 122 and 124 or 132 and 134. The substantially U-shaped members 120 and 130 are rotatably coupled with each other at one or more pivots 128. The pivots 128 are placed generally in the center of the legs 122, 124, 132, and 134 of the substantially U-shaped member 120 and 130. Also, one of the bridging portions 126 is restrained from moving laterally, while the other bridging portion 136 can slide. The nitinol wire assembly 116 is coupled to the second substantially U-shaped members 130 at a hooking portion 138. As best seen in FIG. 2, the nitinol wire assembly 116 loops around the hooking portion 138. The hooking portion 138 can be placed substantially at the center of the bridging portion 136. When the first and second substantially U-shaped members 120 and 130 are lying flat against the base 142, the nitinol wire assembly 116 of the SMA member 102 is stretched and thereby in a deformed state. When a current is applied to the SMA member 102 through the couplings 103, the current causes the nitinol wire assembly 116 to heat up through $P=I^2R$. Thus, as the nitinol wire assembly 116 reaches its transition temperature, the nitinol wire assembly 116 shrinks back substantially to its original shape, and the nitinol wire assembly 116 pulls the hooking portion 138 of the second substantially U-shaped member 130. The pulling causes the bridging portion 136 of the second substantially U-shaped member 130 to move towards the bridging portion 126 of the first substantially U-shaped member 120. Because the legs 122, 124, 132, and 134 are rotatably coupled to each other by the pivots 128, the legs 122, 124, 132, and 134 open away from each other like a pair of scissors. Thus, the first and second substantially U-shaped members 120 and 130 cause the second frame 118 to open into, lift, or expand into the first frame 114.

Returning to FIG. 1, the encoding circuit board 140 is disposed adjacent to and to the rear of the second frame 118. In other embodiments, the encoding circuit board 140 and the touch pad 108 can be formed as a single board. Alternatively, in other embodiments, the rotary switch assembly 100 can include more than one touch pad 108 or more than one encoding circuit board 140. The encoding circuit board 140 includes electrical components, electronics, mechanical components, and other devices that transform or relay the rotational motion of the knob 104 into a signal to be sent to the controlled device, such as a component of an audio entertainment system or a component of a heating and cooling system. The encoding circuit board 140 can be made from a suitable material that provides mechanical support and a mounting surface for the electrical components, electronics, mechanical components, and other necessary devices. In the embodiment shown, the encoding circuit board 140 is a dielectric substrate with electronics on the substrate to transform or relay the rotational motion of the knob 104 into an electric signal to a device to be controlled by the rotary switch assembly 100.

Figure 4:
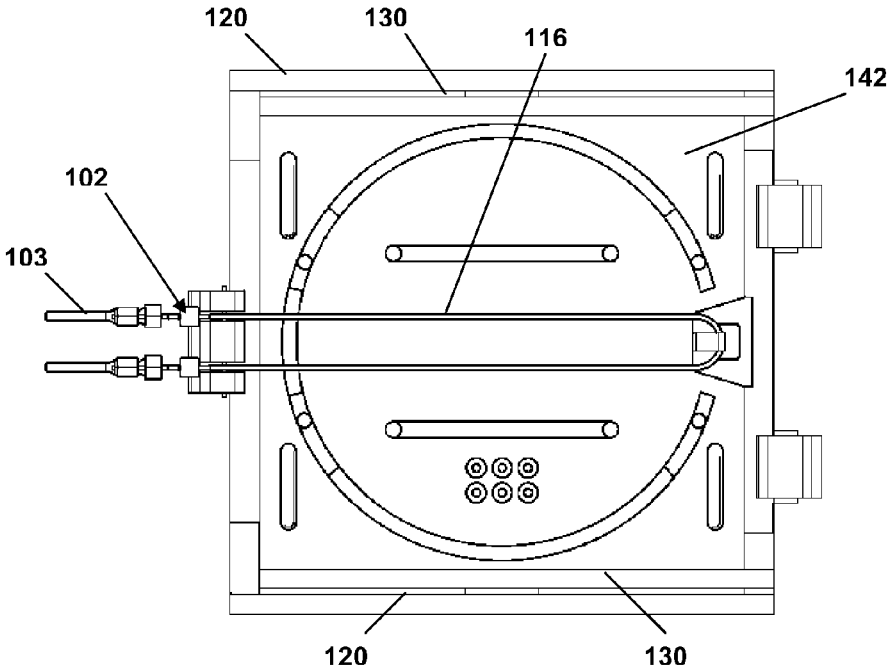
FIG. 4 is an overhead plan view of the shape memory alloy member, the second frame, and a base of the rotary switch assembly illustrated in FIG. 1.

Referring to FIG. 4, the base 142 is shown in an overhead plan view with the second frame 118 and the SMA member 102. The base 142 provides protection and mechanical support to the rotary switch assembly 100. The base 142 can be made from any suitable rigid material, such as, but not limited to, plastics, metals, leathers, glass, wood, combinations of the aforementioned, and other similar materials. As best seen in FIG. 3, the base 142 also laterally restrains the bridging portion 126 of the first substantially U-shaped member 120 and allows the bridging portion 136 of the second substantially U-shaped member 130 to slide as the SMA member 102 changes shape.

Figure 5:
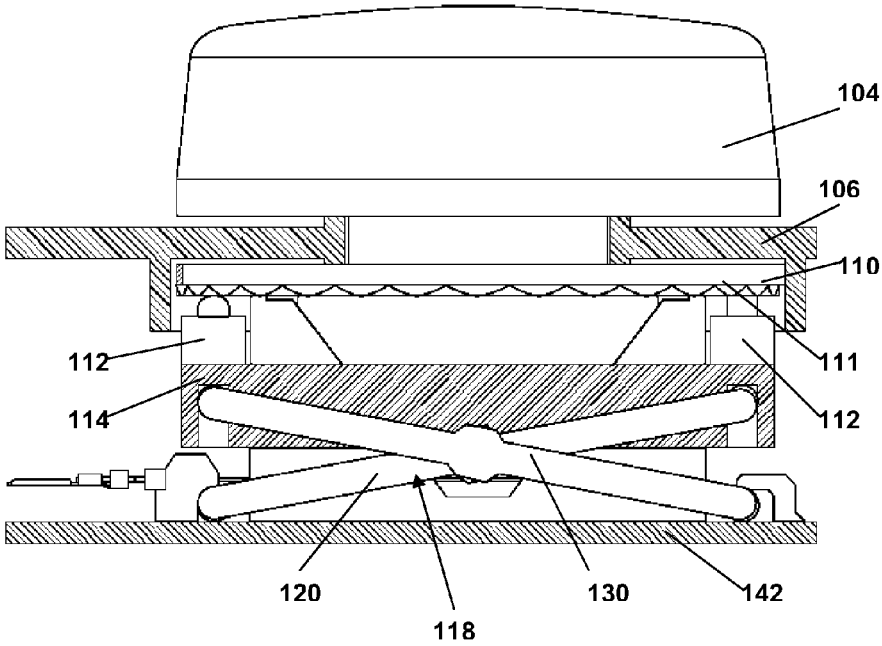
FIG. 5 is a partial sectional side elevational view of the rotary switch assembly illustrated in FIG. 1.
Figure 6:
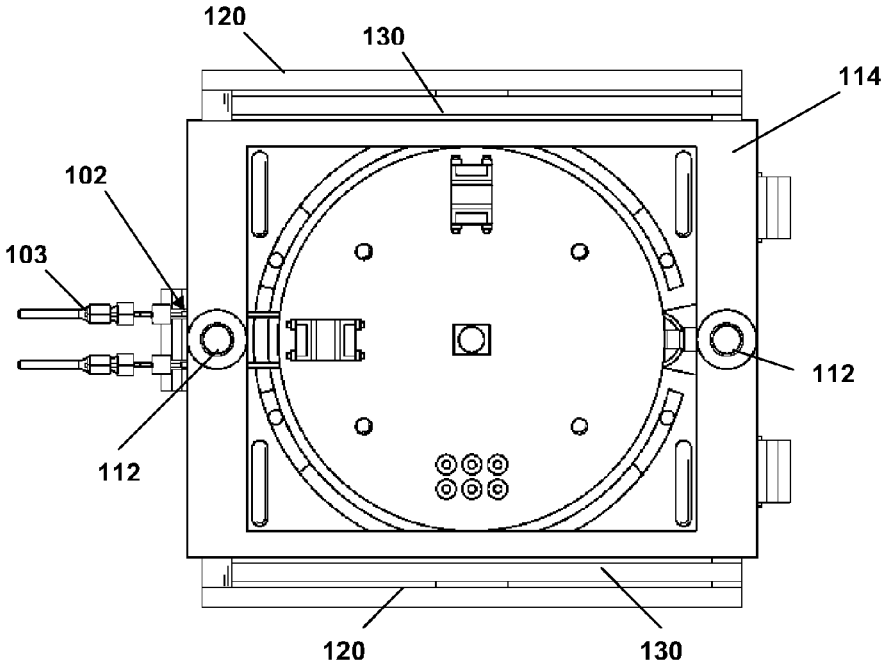
FIG. 6 is an overhead plan view of the shape memory alloy member, the second frame, the base, and a first frame of the rotary switch assembly illustrated in FIG. 1.

Referring to FIGS. 5 and 6, to vary the operational torque or the detent amplitude of the rotary switch member 100, the first frame 114 includes one or more plunger-spring assemblies 112. In the embodiment shown, the first frame 114 includes two plunger-spring assemblies 112 disposed on opposite sides of the first frame 114. As the SMA member 102 changes shape and causes the second frame 118 to lift the first frame 114, the plunger-spring assembles 112 contact the detents 111 of the wheel 110.

Figure 7:
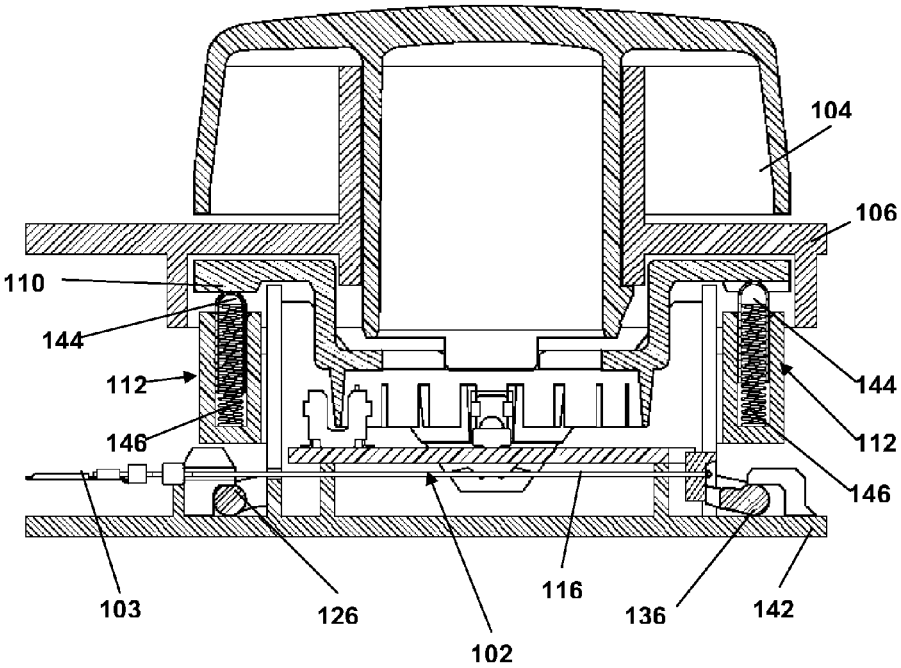
FIG. 7 is a sectional side elevational view of the rotary switch assembly illustrated in FIG. 1.

Referring to FIG. 7, a sectional side elevational view of the rotary switch assembly 100 is shown. Each plunger-spring assembly 112 includes a plunger 144 and a spring 146. One end of the plunger 144 contacts the detents 111 and the spring 146 elastically biases the plunger 144 towards the detents 111. Each spring 146 is at a first compressed state before the second frame 118 lifts the first frame 114, and the first compressed state corresponds to a first operational torque or detent amplitude.

Figure 8:
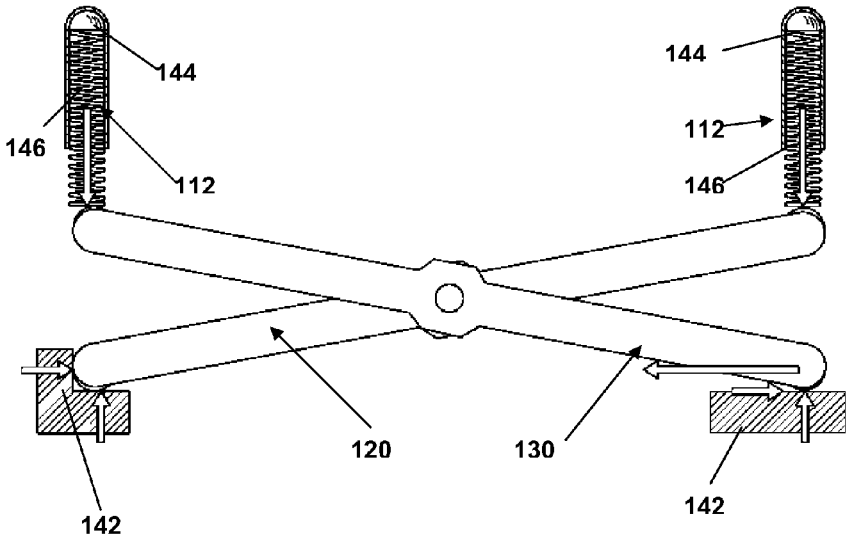
FIG. 8 is a schematic view of the second frame and plunger-spring assemblies of the rotary switch assembly illustrated in FIG. 1.
Figure 9:
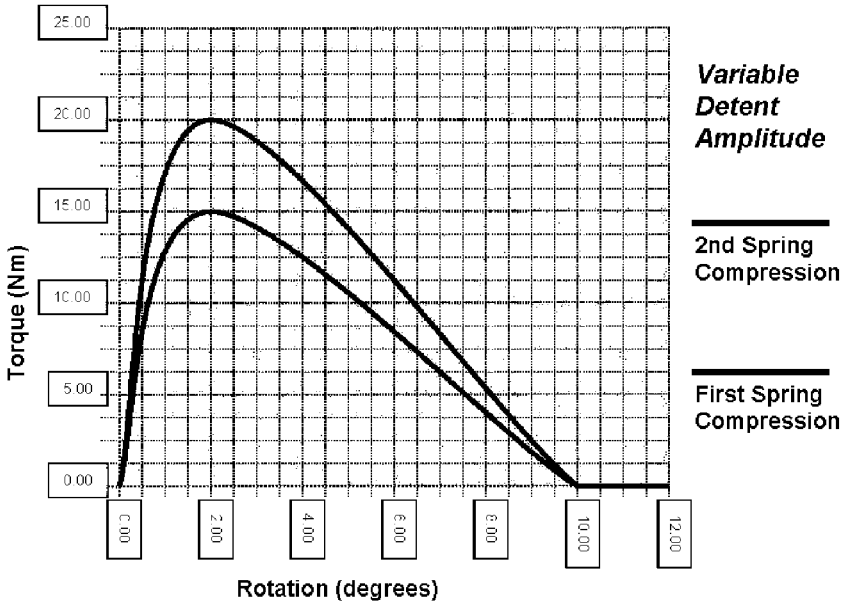
FIG. 9 is a graph of torque versus rotation for the rotary switch assembly illustrated in FIG. 1

Referring to FIG. 8, a simplified schematic view of the plunger-spring assemblies 112, the second frame 118, and the base 142 is shown. When a current is applied to the SMA member 102, the current causes the SMA member 102 to heat up and return substantially to its original shape. As the SMA member 102 returns substantially to its original shape, it causes the second frame 118 to lift the first frame 114 towards the wheel 110. As the first frame 114 moves towards the wheel 110, each spring 146 is compressed to a second compressed state, and the second compressed state corresponds to a second operational torque or detent amplitude. At the second detent amplitude, the user feels a different tactile effect because the operational torque has changed. An example variation in torque in Newton-meters (Nm) versus rotation in degrees is shown in FIG. 9.

Figure 10:
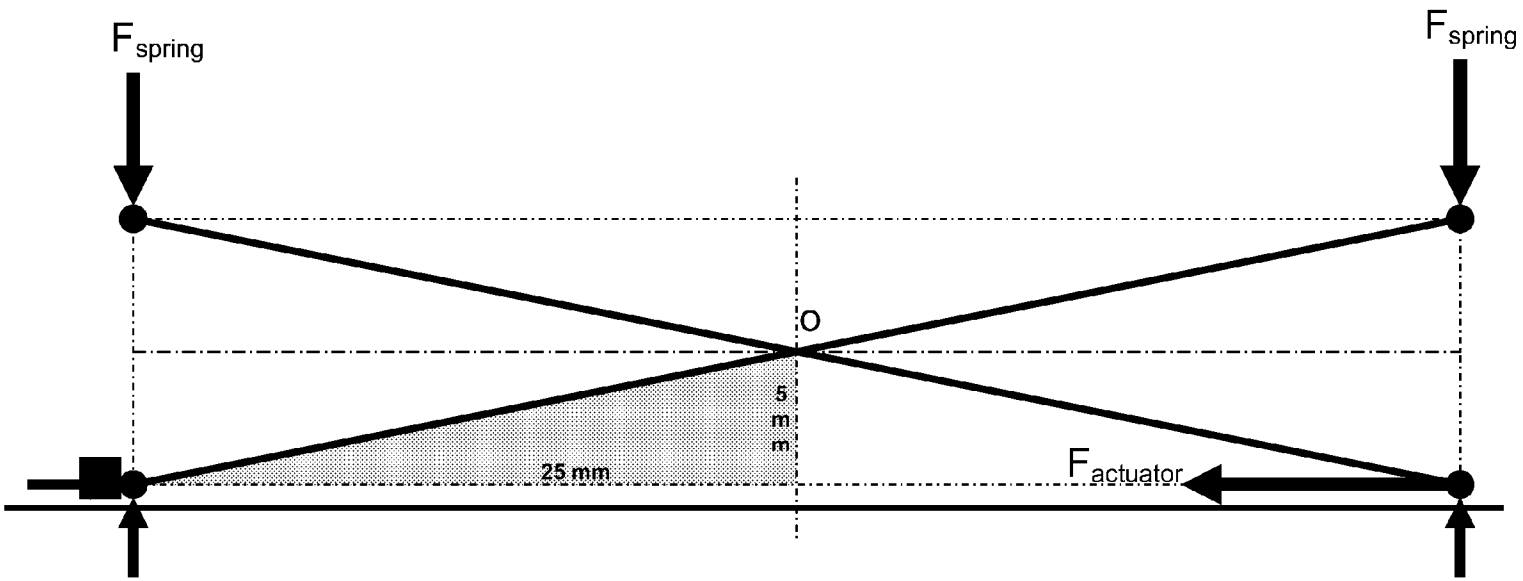
FIG. 10 is a simplified schematic view of the second frame of the rotary switch assembly illustrated in FIG. 1.
Figure 11:
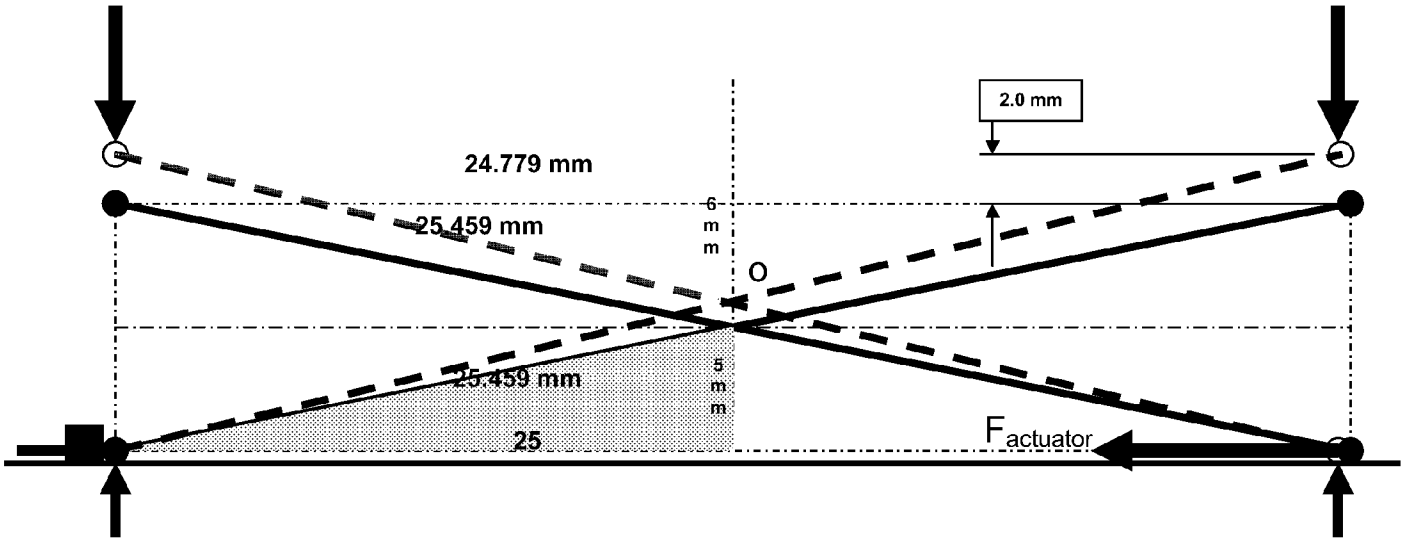
FIG. 11 is a simplified schematic view of the second frame of the rotary switch assembly illustrated in FIG. 1.

Referring to FIGS. 10 and 11, a simplified schematic of the interaction between the SMA member 102, the second frame 118, and the springs 146 is shown. In a theoretical, ideal rotary switch assembly 100 with no friction, the rotary switch assembly 100 exhibits behavior corresponding to the following equation: $\Sigma M_o=0=25\ (F_{spring})+25(F_{spring})-5(F_{actuator})$ or $(F_{actuator})=10(F_{spring})$. Spring forces or $F_{spring}$ for most level detents range from approximately 2.0 Newtons (N) to approximately 2.2 N. After a 20% increase in the $F_{spring}$ caused by compressing the spring 146 about 2.0 mm as shown in FIG. 11, the detent increases to approximately 2.4 N to approximately 2.6 N. Furthermore, the nitinol wire assembly 116 shrinks about 0.442 mm to produce approximately 26 N of pulling force on the second substantially U-shaped member 130.

Referring to FIG. 12, a chart is shown with results from a wire diameter study. The wire diameter study compiled data for deflection force for a given strain and cross-sectional area of the wire within the nitinol wire assembly 116. The chart gives the moduli of elasticity, E, for the martensite and austenite phases of nitinol, and data for a 50 mm wire with a diameter of 0.44 mm Listed are changes in length and the corresponding force developed.

Referring to FIGS. 13 and 14, data is shown for a 30% increase in the spring load $F_{spring}$, and a 20% increase in the spring load $F_{spring}$, respectively. Both charts are for a wire having a length of 53 mm and a diameter of 0.006 inches (0.154 mm) As shown in FIG. 13, at $F_{spring}$=20 N, the wire is deflected 0.8654 mm, and when $F_{spring}$=26 N or about a 30% increase, the wire is 0.4454 mm Referring to FIGS. 15 and 16, charts are shown with data for commercial grade music wire that can also be used with the SMA member 102. Referring to FIG. 17, data is shown for flexinol, another material that can be used the SMA member 102.

Figure 18:
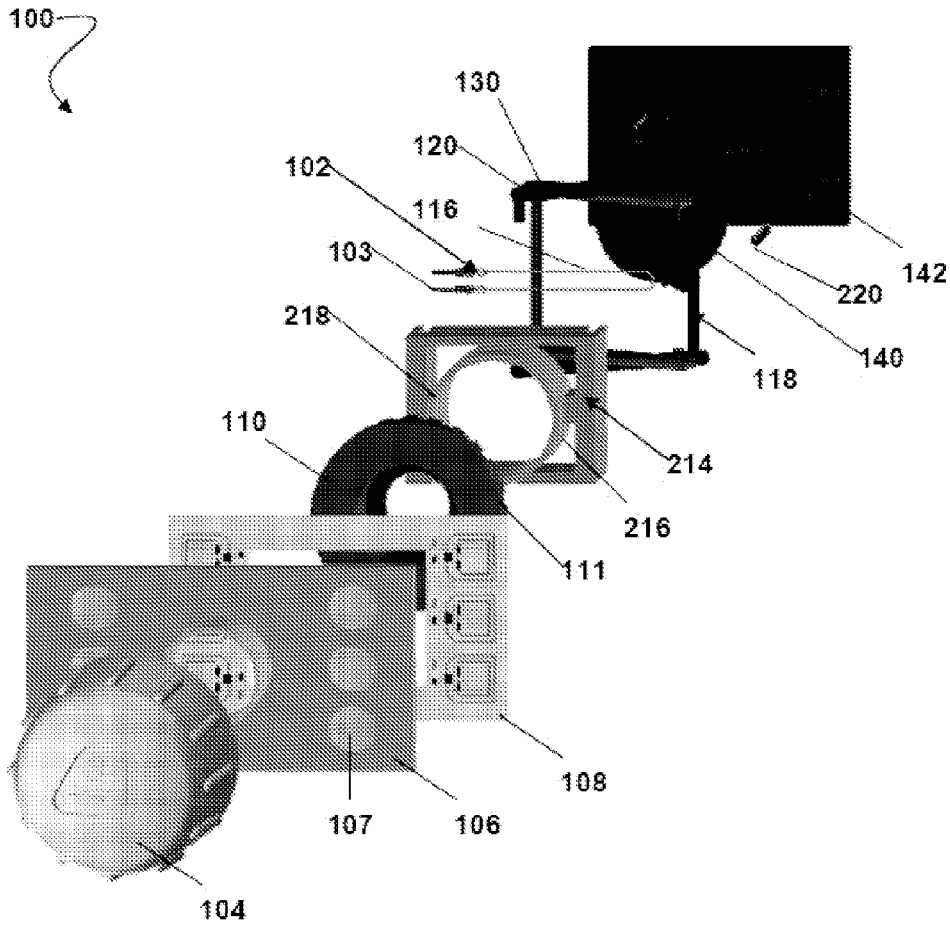
FIG. 18 is an exploded perspective view of a rotary switch assembly with a first frame according to another embodiment of the invention.
Figure 19:
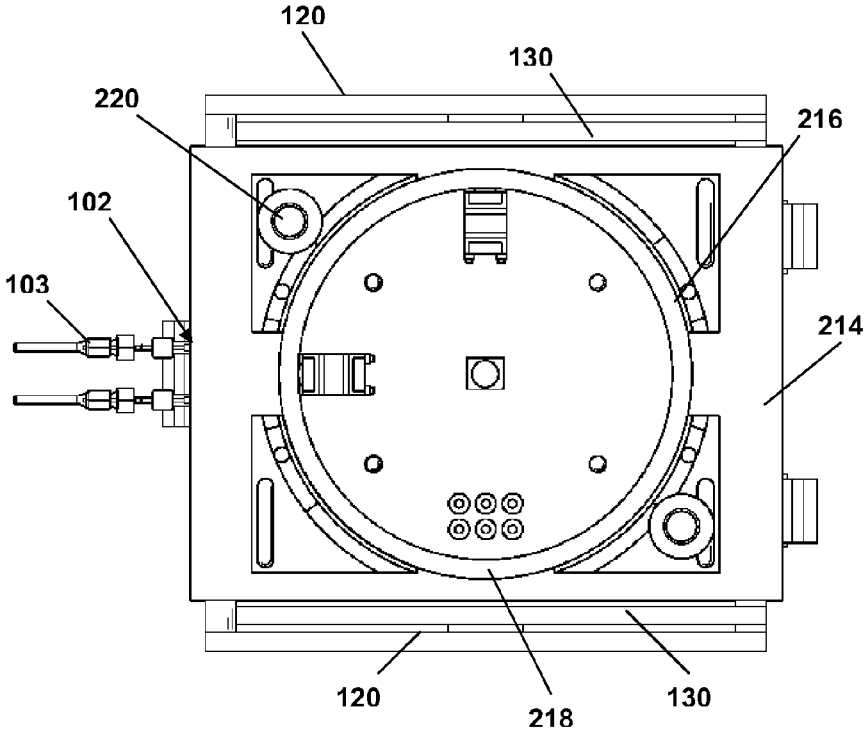
FIG. 19 is an overhead plan view of the first frame, a second frame, a shape memory alloy member, and a base of the rotary switch assembly illustrated in FIG. 18.
Figure 20:
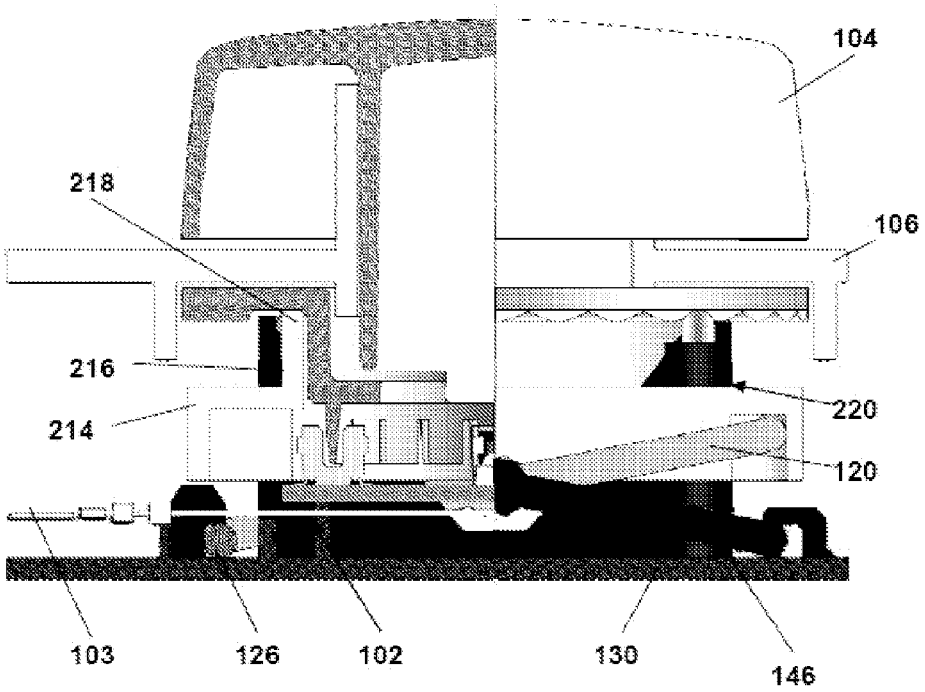
FIG. 20 is a partial sectional side elevational view of the rotary switch assembly illustrated in FIG. 18.
Figure 21:
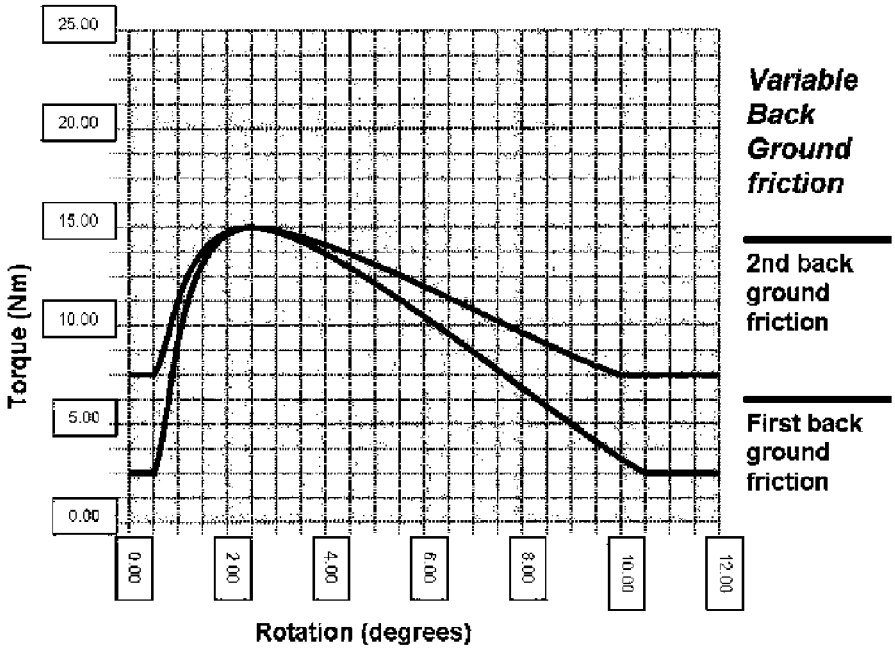
FIG. 21 is a graph of background friction versus rotation for the rotary switch assembly illustrated in FIG. 18.

Referring to FIGS. 18-20, a first frame 214 according to another embodiment is shown. The first frame 214 includes a friction frame 216 to vary the background friction of the rotary switch member 100. The friction frame 216 has a clutch-type friction interface 218 that contacts a surface of the wheel 110. Thus, as the SMA member 102 changes shape and causes the second frame 118 to lift the first frame 214, the clutch-type friction interface 218 is pressed into the surface of the wheel 110. Also, in the embodiment shown, two plunger-spring assemblies 220 are shown, but they are disposed on the base 142 and not on the first frame 214. Thus, the plunger-spring assemblies 220 cannot vary the operational torque because they are not lifted with the first frame 214. An example variation in background friction in Nm versus rotation in degrees is shown in FIG. 21.

Figure 22:
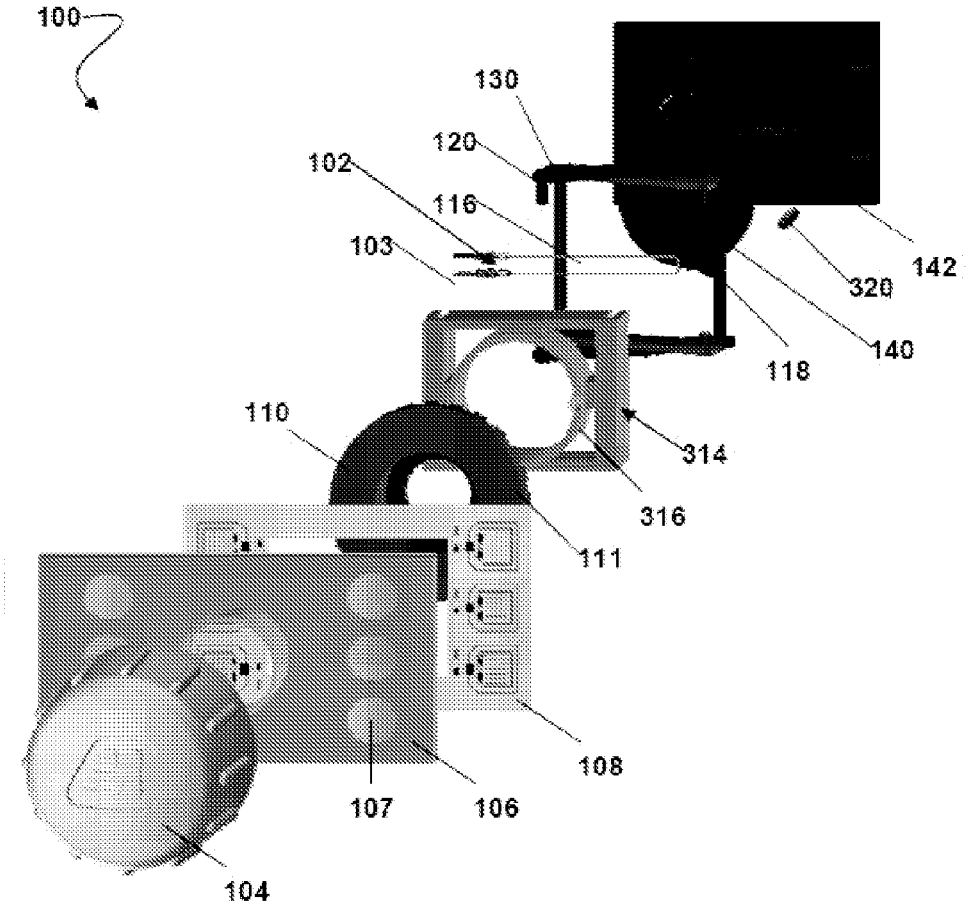
FIG. 22 is an exploded perspective view of a rotary switch assembly with a first frame according to yet another embodiment of the invention.
Figure 23:
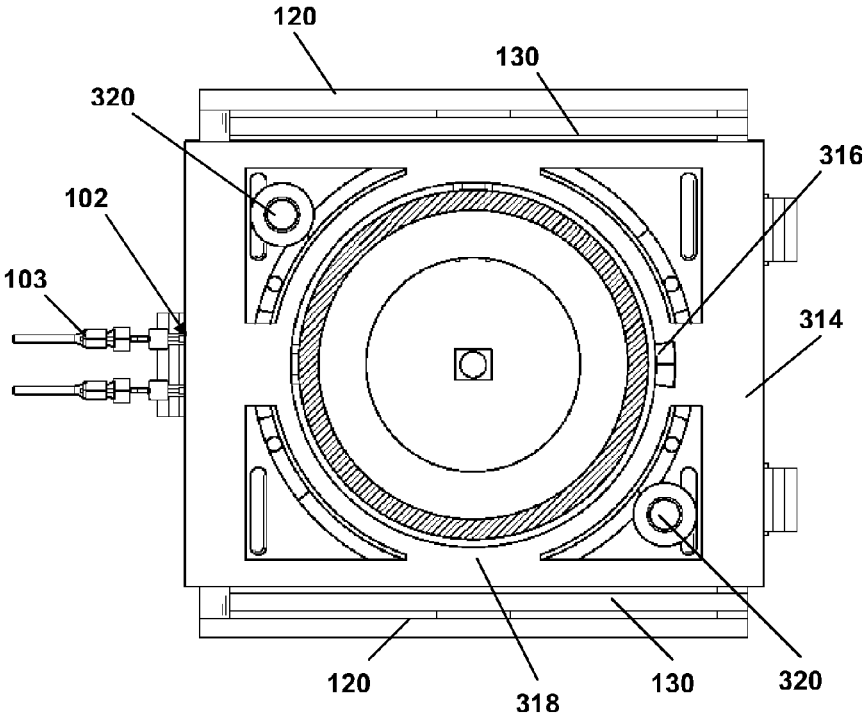
FIG. 23 is an overhead plan view of the first frame, a second frame, a shape memory alloy member, and a base of the rotary switch assembly illustrated in FIG. 22.
Figure 24:
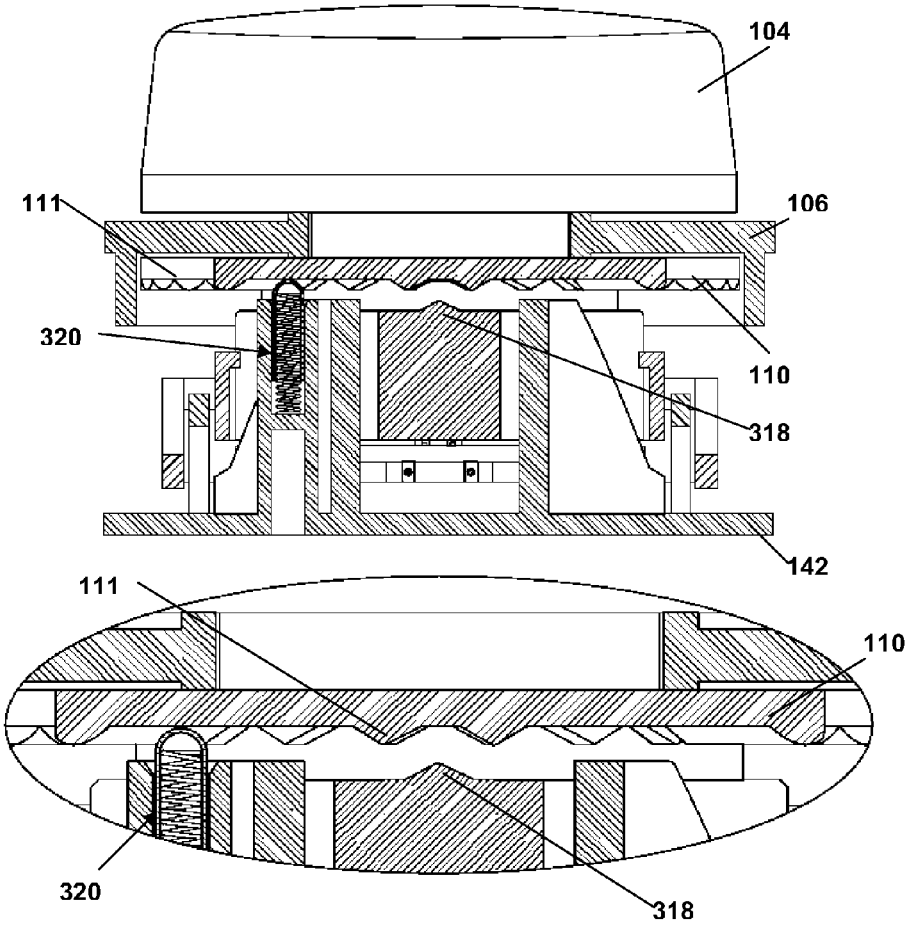
FIG. 24 is a partial sectional side elevational view of the rotary switch assembly illustrated in FIG. 22.

Referring to FIGS. 22-24, a first frame 314 according to yet another embodiment is shown. The first frame 314 includes a stop pin frame 316 to vary the rotational displacement of the rotary switch assembly 100. The stop pin frame 316 includes a stop pin 318 that is shaped to engage the detents 111 of the wheel 110. As the SMA member 102 changes shape and causes the second frame 118 to lift the first frame 314, the stop pin 318 is pressed into the detents 111 of the wheel 110. Also, in the embodiment shown, a plunger-spring assembly 320 is shown, but it is disposed on the base 142 and not on the first frame 314. Thus, the plunger-spring assembly 320 cannot vary the operational torque because it is not lifted with the first frame 314.

Figure 25:
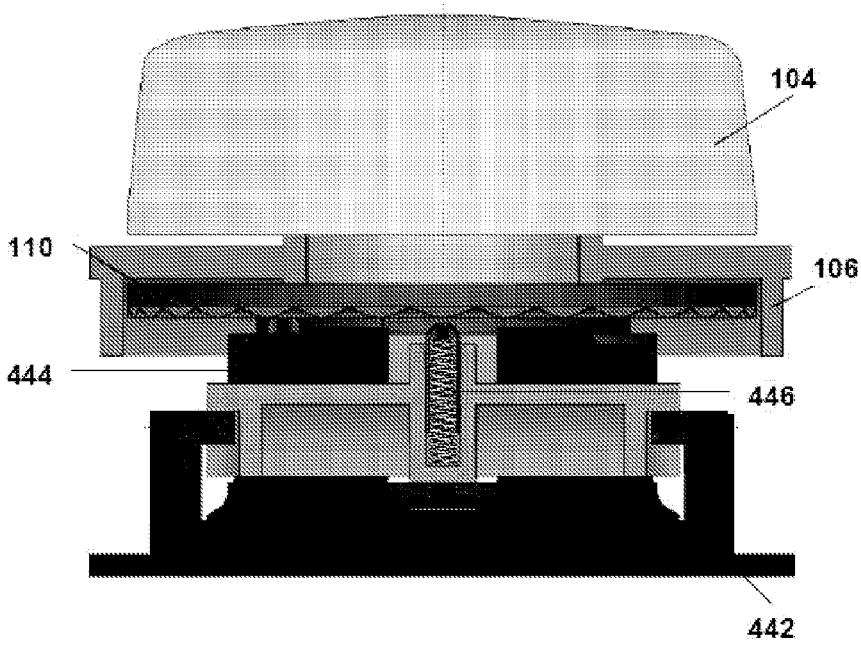
FIG. 25 is a partial sectional side elevational view of a rotary switch assembly with a first frame according to a further embodiment of the invention.
Figure 26:
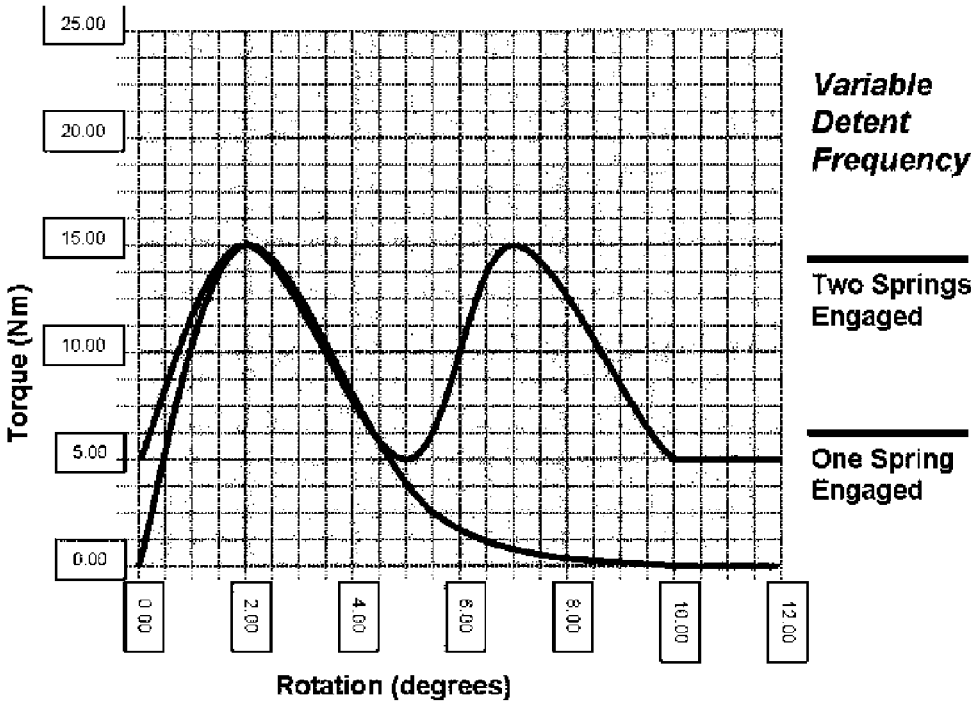
FIG. 26 is a graph of detent frequency versus rotation for the rotary switch assembly illustrated in FIG. 25.

Referring to FIG. 25, a base 442 according to yet another embodiment is shown. The base 442 has a spring and cam follower 444, and the second frame 118 has another spring and cam follower 446 to vary the number of detents per possible rotation. In the embodiment shown, the spring and cam followers 444 and 446 are placed approximately 45° apart. The spring and cam follower 444 disposed on the base 442 provides a first number of detents per possible rotation. After the SMA member 102 changes shape and causes the second frame 118 to lift the other spring and cam follower 446, the other spring and cam follower 446 is pressed into the detents 111 of the wheel 110 and results in a second number of detents per possible rotation. When the spring and cam followers 444 and 446 are placed approximately 45° apart, the number of detents per possible rotation approximately doubles. An example variation in detent frequency versus rotation in degrees is shown in FIG. 26.

Figure 27:
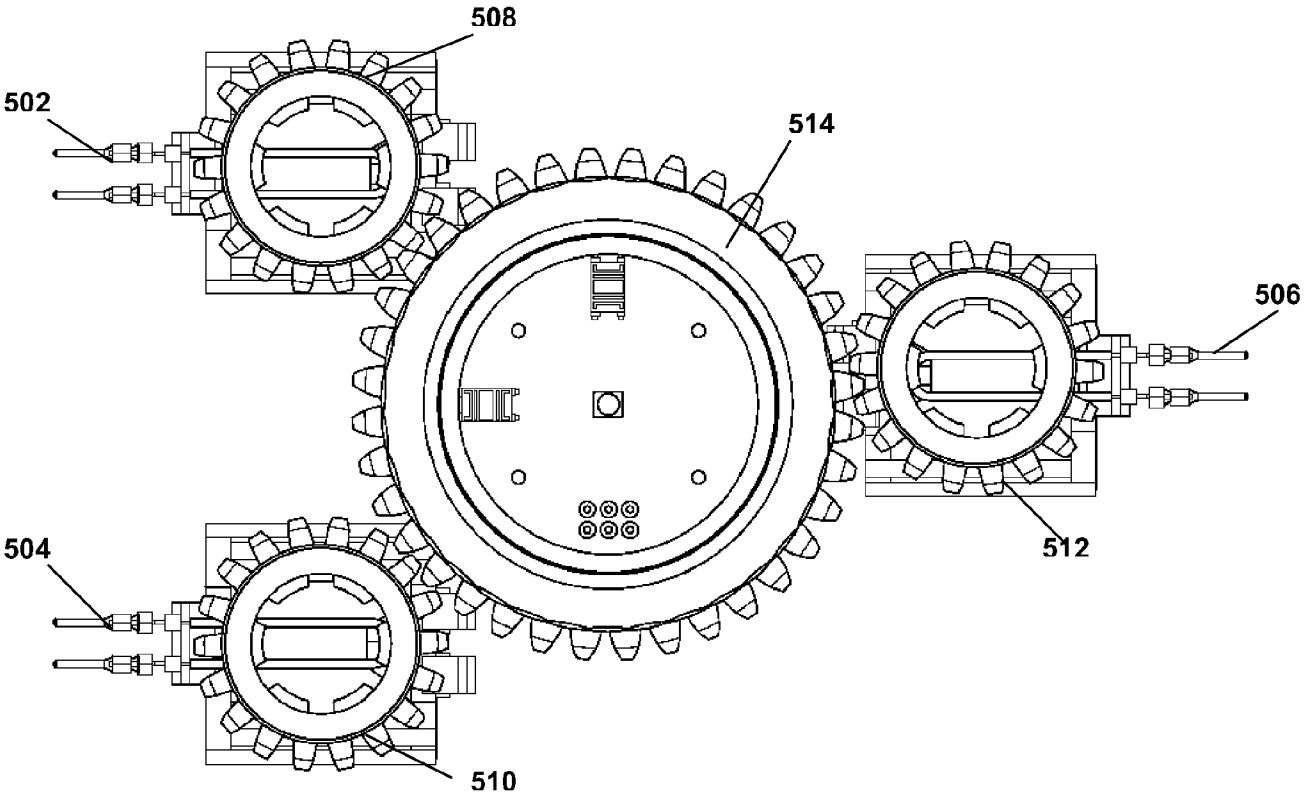
FIG. 27 is an overhead plan view of shape memory alloy members, gears, and a central hub of a rotary switch assembly according to yet another embodiment of the invention.

Referring to FIG. 27, additional SMA members 502, 504, and 506 can be included. The additional SMA members 502, 504, and 506 can each change an aspect of the rotary switch assembly 100, such as the operational torque, the background friction, the total rotational angle, or the number of detents. The force imparted by the SMA members 502, 504, and 506 can be transferred by gears 508, 510, and 512 to a central hub 514. The central hub 514 is coupled to the knob 104 of the rotary switch assembly 100. Thus, the additional SMA members 502, 504, and 506; the gears 508, 510, and 512; and the central hub 514 provide the rotary switch assembly 100 with more than one haptic effect or a variable combination of haptic effects.

As apparent from the above description, the invention provides a rotary switch assembly 100 with haptic effects. The SMA member 102 works in conjunction with a second frame 118 to move a first frame 114 towards a wheel 110 coupled to a knob 104. The movement of the second frame 118 or the movement of the first frame 114, 214, 314, or 414 can vary the operational torque, the background friction, the rotational displacement, the number of detents per possible rotation, or some other attribute of the rotary switch assembly 100. Also, through the use of additional SMA members 502, 504, and 506; gears 508, 510, and 512; and a central hub 514 one or more haptic effects can be combined with other haptic effects. Thus, the rotary switch assembly 100 can be configured with one or more haptic effects, and therefore, the rotary switch assembly 100 can be manufactured with fewer haptic effects thereby reducing its cost.

While a particular embodiment has been chosen to illustrate the invention, it will be understood by those skilled in the art that various changes and modifications can be made therein without departing from the scope of the invention as defined in the appended claims.

What is claimed is:

1. A rotary switch assembly comprising:
a knob;
a wheel coupled to the knob;
a first frame configured to move towards the wheel;
a second frame coupled to the first frame; and
a shape memory alloy member made from a shape memory alloy and coupled to the second frame,
wherein the shape memory alloy member is configured to change shape, and
wherein the second frame is configured to transform the changing shape of the shape memory alloy member into movement of the first frame, thereby providing haptic feedback to a user through the knob.

2. A rotary switch assembly according to claim 1, wherein the shape memory alloy member further comprises a nitinol wire assembly.

3. A rotary switch assembly according to claim 1, wherein the shape memory alloy member further comprises a coupling that allows electrical current to flow through the shape memory alloy member.

4. A rotary switch assembly according to claim 1, further comprising:
a plunger-spring assembly having a plunger and a spring,
wherein the movement of the first frame towards the wheel causes the spring to transition from a first compressed state to a second compressed state thereby changing the operational torque of the rotary switch assembly.

5. A rotary switch assembly according to claim 1, further comprising:
a clutch type friction interface disposed on the first frame,
wherein the movement of the first frame towards the wheel causes the clutch type friction interface to press into a surface of the wheel thereby changing background friction of the rotary switch assembly.

6. A rotary switch assembly according to claim 1, further comprising:
a stop pin disposed on the first frame; and
a plurality of detents disposed on the wheel,
wherein the movement of the first frame towards the wheel causes the stop pin to engage one of the plurality of detents thereby changing the rotational displacement of the rotary switch assembly.

7. A rotary switch assembly according to claim 1, further comprising:
a base coupled to the second frame;
a plurality of detents disposed on the wheel;
a first spring and cam follower disposed on the base, the first spring and cam follower engaging the plurality of detents to provide a first number of detents per rotation; and
a second spring and cam follower coupled to the second frame,
wherein the changing shape of the shape memory alloy member causes the second spring and cam follower to engage the plurality of detents to provide a second number of detents per rotation.

8. A method of manufacturing a rotary switch assembly, the method comprising the steps of:
providing a shape memory alloy member made from a shape memory alloy;
providing an extendable frame;
coupling the shape memory alloy member to the extendable frame such that the changing shape of the shape memory alloy member extends the extendable frame;
providing a surface that engages the extendable frame;
disposing the surface a predetermined distance away from the extendable frame;
coupling the extendable frame to the surface such that extending the extendable frame causes the extendable frame to engage the surface; and
coupling a knob to the surface,
wherein the knob is configured to provide haptic feedback to a user when the extendable frame engages the surface.

9. A method of manufacturing according to claim 8, further comprising the step of providing a coupling that allows electrical current to flow to the shape memory alloy member.

10. A method of manufacturing according to claim 8, wherein the shape memory alloy member comprises a nitinol wire assembly.

11. A method of manufacturing according to claim 8, further comprising the steps of:
disposing a plunger on the extendable frame to engage the surface; and disposing a spring on the extendable frame to elastically bias the plunger towards the surface.

12. A method of manufacturing according to claim 8, further comprising the step of disposing a clutch type friction interface on the extendable frame.

13. A method of manufacturing according to claim 8, further comprising the steps of:

disposing a plurality of detents on the surface; and disposing a stop pin on the extendable frame to engage one of the plurality of detents.

14. A method of manufacturing according to claim 8, further comprising the steps of:

coupling a base to the extendable frame;

disposing a plurality of detents on the surface;

disposing a first spring and cam follower on the base to engage the plurality of detents;

disposing a second spring and cam follower on the extendable frame to engage the plurality of detents.

* * * * *